US006224160B1

(12) United States Patent
Takeuchi et al.

(10) Patent No.: US 6,224,160 B1
(45) Date of Patent: May 1, 2001

(54) BODY SUPPORTING APPARATUS

(75) Inventors: Hiroshi Takeuchi; Shigenori Takehara; Koji Katayama, all of Osaka (JP)

(73) Assignee: Itoki Crebio Corporation, Osaka (JP)

( * ) Notice: Subject to any disclaimer, the term of this patent is extended or adjusted under 35 U.S.C. 154(b) by 0 days.

(21) Appl. No.: 09/219,440

(22) Filed: Dec. 23, 1998

(30) Foreign Application Priority Data

Dec. 25, 1997 (JP) ..... 9-356828
Jul. 9, 1998 (JP) ..... 10-194239
Jul. 23, 1998 (JP) ..... 10-208179

(51) Int. Cl.[7] ..... A47C 7/00
(52) U.S. Cl. ..... 297/440.15; 297/452.55
(58) Field of Search ..... 297/440.22, 452.55, 297/440.15

(56) References Cited

U.S. PATENT DOCUMENTS

| | | | | |
|---|---|---|---|---|
| 3,841,704 | * | 10/1974 | Platner et al. | 297/452.55 |
| 3,851,920 | * | 12/1974 | Harris et al. | 297/440.22 X |
| 3,907,363 | * | 9/1975 | Baker et al. | 297/452.55 |
| 4,709,894 | | 12/1987 | Knoblock et al. | 248/406.2 |
| 4,720,142 | | 1/1988 | Holdredge et al. | 297/300 |
| 4,744,603 | | 5/1988 | Knoblock | 297/457 |
| 4,872,635 | | 10/1989 | Knoblock et al. | 248/406.2 |
| 5,050,931 | | 9/1991 | Knoblock | 257/311 |
| 5,333,934 | | 8/1994 | Knoblock | 297/452.15 |
| 5,352,022 | | 10/1994 | Knoblock | 297/452.15 |
| 5,487,591 | | 1/1996 | Knoblock | 297/452.14 |
| 5,567,012 | | 10/1996 | Knoblock | 297/303.3 |
| 5,599,069 | * | 2/1997 | Lorbiecki | 297/440.22 X |
| 5,611,598 | | 3/1997 | Knoblock | 297/452.14 |
| 5,662,381 | * | 9/1997 | Roosien et al. | 297/440.22 X |
| 5,725,277 | | 3/1998 | Knoblock | 297/300.4 |
| 5,806,930 | | 9/1998 | Knoblock | 297/300.1 |
| 5,820,221 | * | 10/1998 | Greaves et al. | 297/440.22 X |

FOREIGN PATENT DOCUMENTS

| | | |
|---|---|---|
| 4-118059 | 10/1992 | (JP) . |
| 8-22250 | 3/1996 | (JP) . |
| 9-182643 | 7/1997 | (JP) . |
| 9-191971 | 7/1997 | (JP) . |

* cited by examiner

*Primary Examiner*—Peter M. Cuomo
*Assistant Examiner*—Stephen Vu
(74) *Attorney, Agent, or Firm*—Michael D. Bednarek; Shaw Pittman

(57) ABSTRACT

A chair is provided which includes an inner member for supporting the body of a person and an outer member for supporting the right and left edges of the inner member. The inner member is made of a synthetic resin and formed into a plate so that the inner member is elastically deformed under the weight of the person. The inner member is attached to the outer member with its side portions supported. Thus, behind the inner member is a space for allowing the inner member to be deformed. In order to be applied to the seat of a chair, preferably, the outer member includes a metal base and a pair of auxiliary supporting elements to be fitted on the metal base. The inner member and the auxiliary supporting elements are fixed to each other in a non-releasable manner by an engaging assembly including engagement nails and engagement holes.

17 Claims, 14 Drawing Sheets

103b
103
32c
4
32
16
32a
104
3
12
17
21 20
19 18
24
32b
105
30
23
106
2
9
51 11
13
122
10b
14
10
(25) 15
7
40
10a
6
1
8
17
5
5a

FIG. 2
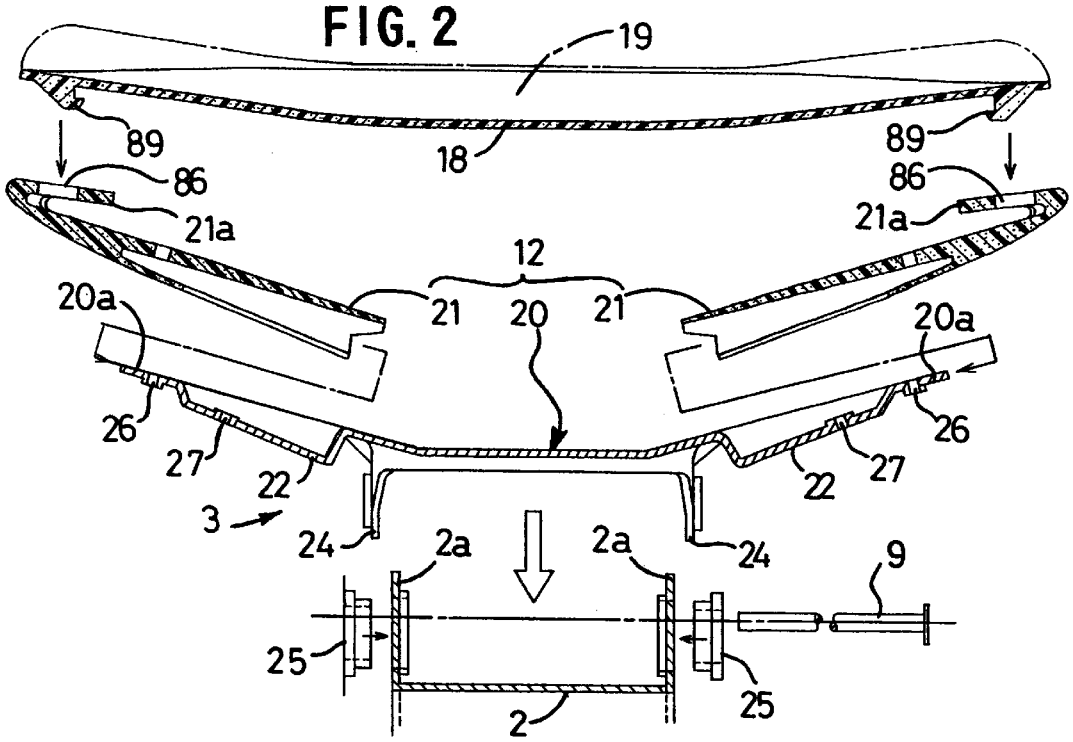
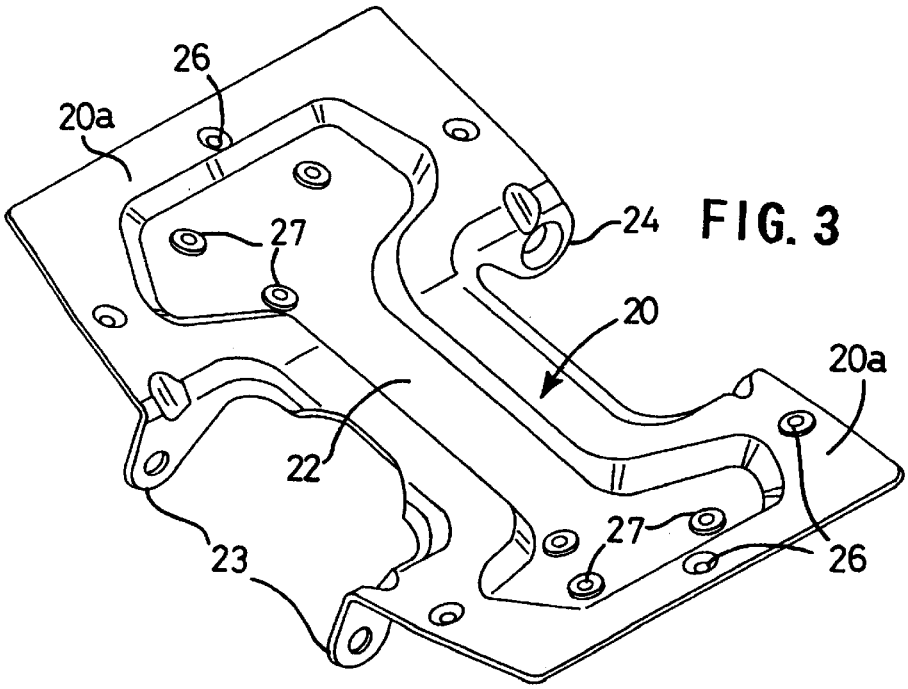
FIG. 3

FIG. 12
FIG. 11
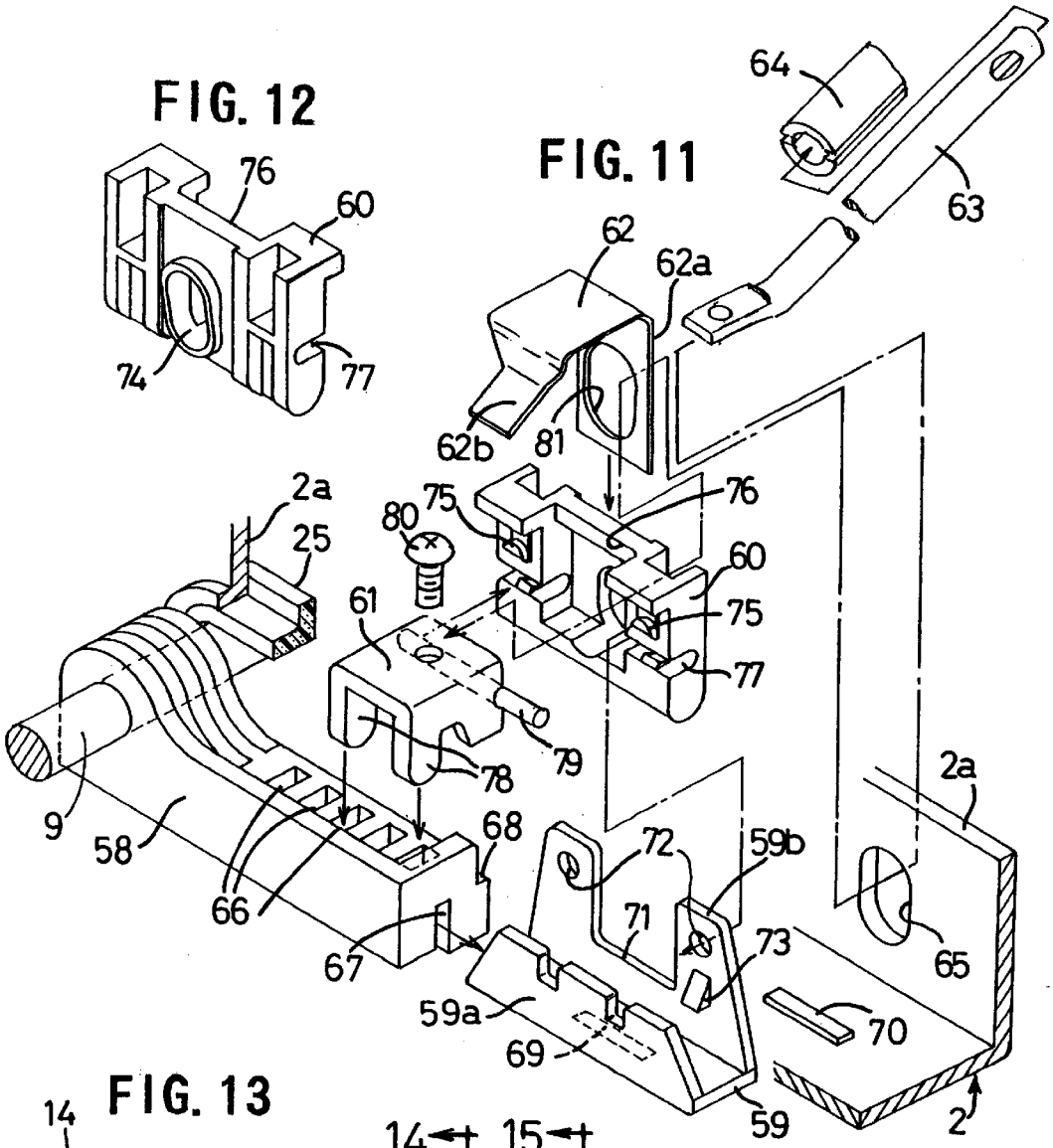
FIG. 13
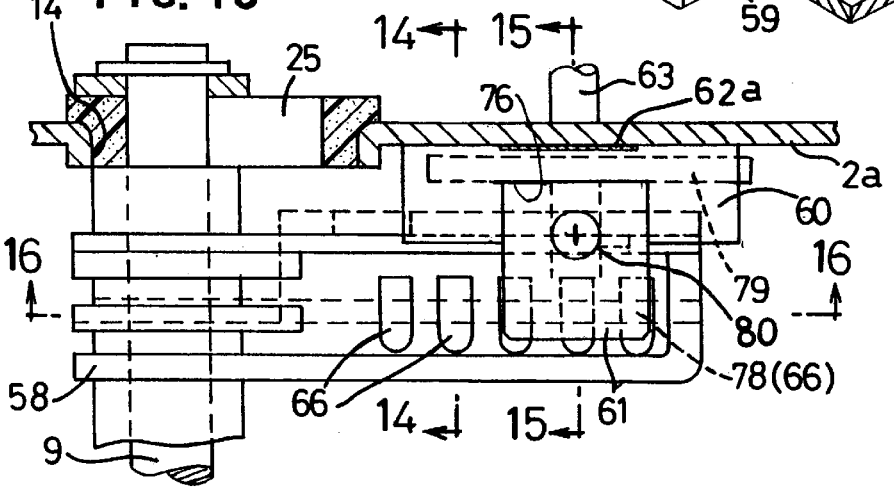

BODY SUPPORTING APPARATUS

BACKGROUND OF THE INVENTION

1. Field of the Invention

The present invention relates to a body supporting apparatus such as a chair, a sofa, a bed and a stretcher. In this specification, the word "body" means both a body of a human being and a body of an animal.

2. Description of the Related Art

A typical example of body supporting apparatus is a chair. The commonest technique used for giving a soft, comfortable touch to a chair's seat and seat back is to attach a thick cushion made of a sponge or urethane foam to the base plates of the chair's seat and the seat back.

In order to produce a chair which is comfortable to sit on, it is necessary to support the weight of a body uniformly by a large area of the seat and the seat back. In other words, the body should be prevented from being pressed only at particular points.

In this regard, a cushion tends to be easily flattened while being repeatedly compressed in use. The thus flattened cushion cannot properly disperse the weight of the body, thereby failing to provide an appropriate weight-supporting function.

In view of this, various methods have been proposed to improve the weight-supporting function of a chair. For instance, Japanese Utility Model Application Laid-open No. 4-118059 discloses an improved arrangement of a seat back. Specifically, it teaches that an outer member constituting a rear side portion of the seat back can be made of a flexible synthetic resin material. With such an arrangement, when a person leans on the seat back, the outer member is deformed elastically, thereby allowing the seat back to incline backward.

Generally, for providing an excellent rocking performance, it is necessary to utilize a large area of the seat back in order to equally support the load applied by the upper part of a person's body. To this end, particular portions of the seat back which support a greater pressure applied by the person's body should be arranged to deform to a greater extent than the other portions of the seat back. In other words, the seat back needs to be deformed suitably to fit the person's body. However, according to the arrangements disclosed in Japanese Utility Model Application Laid-open No. 4-118059, the rocking function of the seat back is provided only by the elastic deformation of the outer member while the seat back itself fails to perform appropriate deformation to fit the person's body.

Japanese Patent Application Laid-open No. 9-182643 teaches that a base member of a seat and a base member of a seat back are both hollow. Peripheral walls of these bodies are arranged to have a bellows-like configuration. In such an arrangement, weight-supporting function is provided by utilizing the elastic deformation of the bellows-like peripheral walls.

According to the arrangements disclosed in Japanese Patent Application Laid-open No. 9-182643, it is possible to obtain a better weight-supporting performance than by the arrangements of Japanese Utility Model Application Laid-open No. 4-118059. However, the former arrangements are disadvantageous in that the hollow bodies are difficult to precisely make from a synthetic resin material.

According to another example of prior art applied to a chair or a bed, use is made of a cloth which is spanned on a metal frame. However, a cloth tends to lengthen while being repeatedly used. Thus, a cloth is not used for a chair required to have durability.

According to still another example of prior art applied to a chair's seat, use is made of a seat supporting member having a net-like configuration. This seat supporting member, which is made of a synthetic resin by injection molding, is fixed to a frame and covered with a cushion. Such an arrangement is similar to that of a hammock, and the thus arranged seat supporting member tends to be excessively deformed, thereby failing to stably support the person's body. Thus, the above arrangement is not necessarily suitable for a chair to be used in an office for a long period of time.

SUMMARY OF THE INVENTION

It is, therefore, a principal object of the present invention to provide a body supporting apparatus which can be readily assembled and is capable of offering excellent weight-supporting performance and good durability.

Another object of the present invention is to provide a body supporting apparatus arranged to be easily and firmly constructed.

A body supporting apparatus according to the present invention comprises an inner member for supporting a body and an outer member for supporting the inner member. The inner member is made of a synthetic resin and formed into a plate, so that the inner member is elastically deformed under a weight of the body. Further, the inner member includes end portions which are located on a right and a left sides of the body supported by the inner member. The inner member is attached to the outer member with the end portions held in a supported state so that the inner member is allowed to be elastically deformed under the weight of the body.

The inner member of the present invention is formed separately from the outer member. Thus, it is possible to produce the inner member precisely by e.g. injection molding. Further, the inner member is attached to the outer member in such a manner that the end portions of the inner member are supported by the outer member. Thus, the inner member can be elastically deformed under the weight of a person, so that the inner member fits the shape of the person's body.

Therefore, according to the present invention, it is possible to easily produce a body supporting apparatus which can fit a body well. Further, since the inner member comprises a plate, it will not be excessively deformed, which differs from the conventional net-shaped inner member. In addition, the inner member of the present invention has excellent durability.

According to the present invention, for offering better weight-supporting performance, the inner member is provided with a plurality of slits. Due to the presence of the numerous slits, regions of the inner member to which a comparatively great load is applied will be caused to sag to a greater extent. In this manner, the weight of the body to be supported is distributed over a wide range of the inner member, whereby improved weight-supporting performance is obtained.

It should be noted that the slits of the present invention differ from the slits disclosed in Japanese Patent Publication No. 8-22250. Specifically, in Japanese Patent Publication No. 8-22250, use is made of an inner seat member and an inner back member which are integrally formed with each other. In order to allow the inner back member to incline backward, slits are formed in a portion which connects the two inner members. On the other hand, the slits of the present invention are provided for allowing the inner member to sag. Thus, the slits of the above publication and the slits of the present invention are different in function and location.

As an another way to offer improved weight-supporting performance, according to the present invention, the outer member may be made up of a metal base and auxiliary supporting elements made of a synthetic resin, wherein the metal base is prepared separately from the auxiliary supporting elements. The auxiliary supporting elements are elastically deformable. With such an arrangement, not only the inner member but also the auxiliary supporting elements are deformed under the weight of a body. Thus, the inner member and the auxiliary supporting elements are, as a whole, allowed to sag. In this manner, the auxiliary supporting elements of the outer member also offer good weight-supporting performance, whereby much improved weight-supporting performance is obtainable. (Thus, the present invention is preferably applied to a seat of a chair and a bed which are required to offer particularly good weight-supporting performance.)

It is possible to use a slit-formed inner member together with an outer member which includes a base and auxiliary supporting elements separate from the base.

Another body supporting apparatus according to the present invention comprises an inner member for supporting a body and an outer member for supporting the inner member. The inner member is made of a synthetic resin and formed into a plate, so that the inner member is elastically deformable under a weight of the body. The inner member includes end portions which are located on a right and a left sides of the body supported by the inner member. Further, the inner member is attached to the outer member with the end portions held in a supported state so that the inner member is allowed to be elastically deformed under the weight of the body. In addition, the inner member is integrally formed, at a right and a left edges of the inner member, with embracing portions via hinged portions. The embracing portions are arranged to be folded back to a rear side of the outer member to be fixed to the outer member.

As stated above, the inner member is provided with embracing portions. Thus, the inner member can overlap the outer member through a great area, so that the inner member and the outer member are fixed to each other more firmly.

By using engaging means including engagement nails and engagement holes, the inner member and the outer member can be easily attached to each other.

According to the present invention, arrangements may be grade for allowing the body of a person to come into direct contact with the inner member. Preferably, however, a cushion such as a sponge may be arranged over a surface of the inner member when the present invention is applied to a chair or bed.

The cushion may be covered by a cloth. Conventionally, a cloth is wrapped up around a cushion and then attached to the inner member. In this arrangement, however, the fixing operation can be troublesome.

According to the present invention, the inner member is arranged to overlap the outer member. Thus, when the inner member is fixed to the outer member in a superimposing manner with a cloth extended onto the rear side of the inner member, the edges of the cloth are advantageously hidden by the outer member. Thus, the edges of the cloth may simply be adhered to the rear surface of the inner member without being particularly decorated. In this manner, the fixing operation of the cushion and the cloth is easily performed.

Other objects, features and advantages of the present invention will become clearer from the detailed description of preferred embodiments given below with reference to the accompanying drawings.

BRIEF DESCRIPTION OF THE DRAWINGS

In the accompanying drawings:

FIG. 2 is an exploded front view showing a seat;

FIG. 3 is a perspective view showing a base which constitutes an outer seat member;

FIG. 11 is an exploded, perspective view showing a position-adjusting mechanism for a seat back;

FIG. 12 is a perspective view showing a shaft-receiving member, as viewed from outside, which is incorporated in the position-adjusting mechanism for the seat back;

FIG. 13 is a plan view showing the position-adjusting mechanism for the seat back;

DETAILED DESCRIPTION OF THE PREFERRED EMBODIMENTS

The preferred embodiments of the present invention will be described below with reference to the accompanying drawings.

(1) First Embodiment (FIGS. 1–41)

Figure 1:
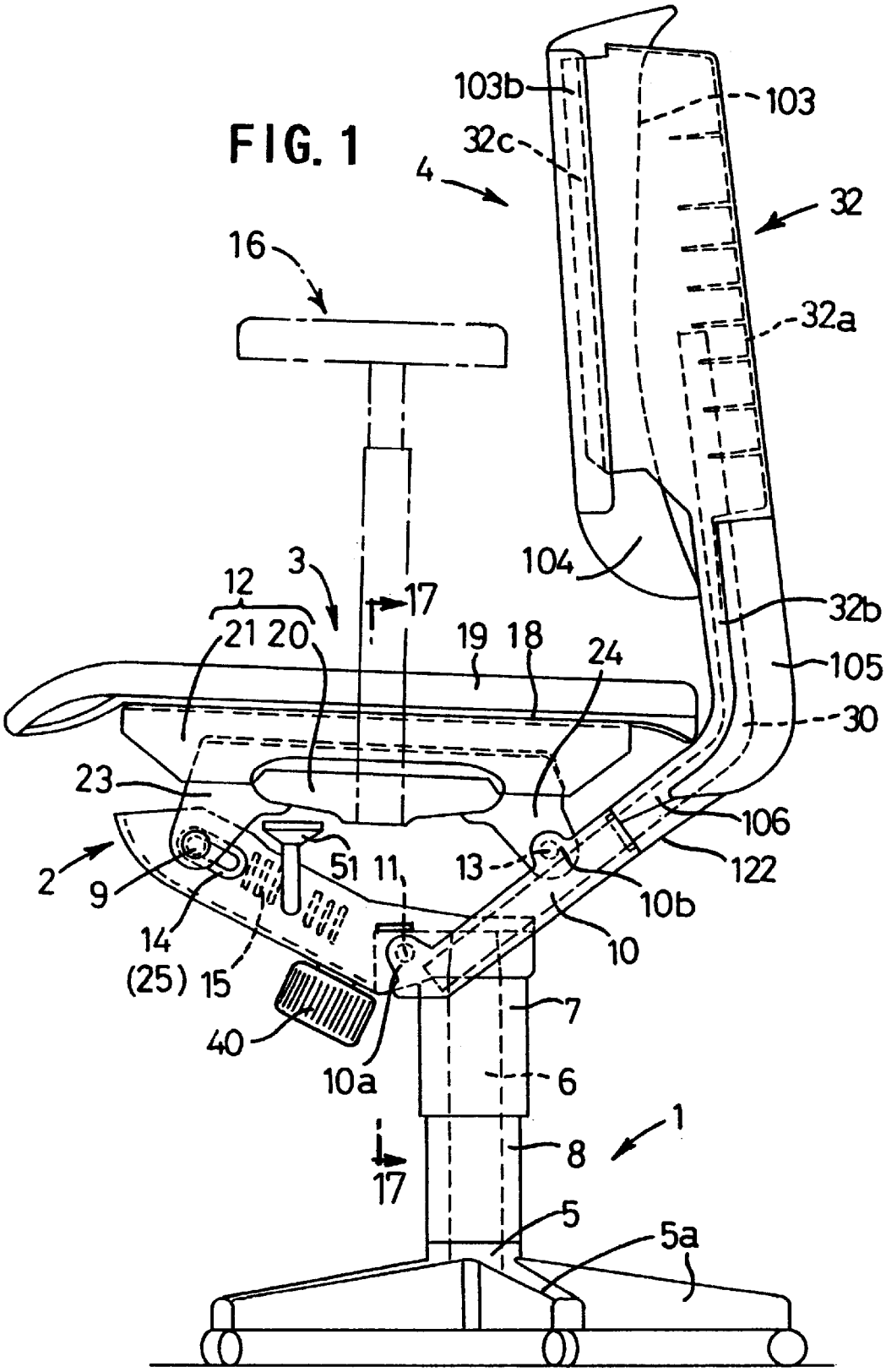
FIG. 1 is a right side view showing a chair according to a first embodiment.

FIGS. 1–41 show a first embodiment of the present invention applied to a chair. Reference will first be made to FIGS. 1 and 2 to describe the chair in outline.

The chair includes a leg unit 1, a seat holder 2, a seat 3 and a seat back 4. The leg unit 1 includes a floor-contacting portion 5, which is provided with branch bars 5*a* extending radially in a plan view, and a gas cylinder 6 standing upright at the center of the floor-contacting portion 5. The gas cylinder 6 is surrounded by an upper and a lower covers 7, 8 which are slidably fitted to each other. The upper cover 7 is attached to a lower surface of the seat holder 2.

The seat holder 2 has a rear portion fixed to an upper end of the gas cylinder 6. The seat holder 2 has an upwardly open, box-like configuration, as shown in e.g. FIG. 2, and is held in a slanting position where a front end of the seat holder is located at a higher elevation.

The seat 3 is coupled to a front portion of the seat holder 2 via a laterally-extending first shaft 9. The seat back 4 is fixed to paired arms 10, which are laterally spaced. Each arm extends slantingly upward from a rear portion of the seat holder 2. Front ends of the respective arms 10 are fixed to laterally-spaced side surfaces of the seat holder 2 via a laterally-extending second shaft 11. Intermediate portions of the respective arms 10 are pivotably coupled, via a laterally-extending third shaft 13, to a rear portion of an outer seat member 12.

For allowing insertion of the first shaft 9, the seat holder 2 is formed with first shaft-receiving bores 14 each of which is elongated generally in a front-rear direction. The first shaft 9 is supported by a rocking spring 15. Thus, when a person sitting on the chair leans on the seat back 4, the seat back 4 is inclined backwards about the second shaft 11 against the restoring force of the spring 15. At the same time, the seat 3 is moved backwards against the spring 15 and also inclined backwards slightly about the first shaft 9.

As depicted by single-dot chain lines in FIG. 1, the chair is provided with armrests 16. However, the armrests are technically irrelevant to the present invention, whereby no description will be given to them. In the first embodiment, the present invention is embodied in arrangements of the seat 3 and the seat back 4. Detailed description about the seat and the seat back will be given below.

① Components and Supporting Structure of the Seat 3

As shown in FIG. 2 for example, the seat 3 includes an outer seat member 12 arranged at a lower elevation, an inner seat member 18 arranged above the outer seat member 12, and a cushion 19 arranged over the inner seat member 18.

The outer seat member 12 is made up of a metal base 20 and a pair of right and left auxiliary supporting elements 21. These supporting elements are attached to the base 20. As shown in FIG. 3, the base 20 is formed with a right and a left spanning portions 20*a*, so that the base has a generally H-shaped configuration as viewed in plan. Each of the spanning portions 20*a* is tapered toward its extremity, thereby providing a generally trapezoidal configuration. Further, as viewed in front, each spanning portion 20*a* is slightly inclined upward (this arrangement is for providing some space below the inner seat member 18). Mainly for reinforcing purposes, the base 20 is formed with a dent (downwardly-bulging portion) 22 which is similar in configuration to the base as viewed in plan.

The spanning portions 20*a* of the base 20 are formed with first threaded bores 26 disposed outside of the dent 22 and second threaded bores 27 inside of the dent. The first threaded bores 26 outside of the dent 22 are used for fixing the auxiliary supporting elements 21, while the second threaded bores 27 in the dent 22 are used for fixing the armrests 16 (see FIG. 1).

The right and the left spanning portions 20*a* of the base 20 are provided with downwardly-protruding front brackets 23 and rear brackets 24. These brackets are arranged beside the seat holder 2. The first shaft 9 extends through the front brackets 23, while the third shaft 13 extends through the rear brackets 24.

Figure 4:
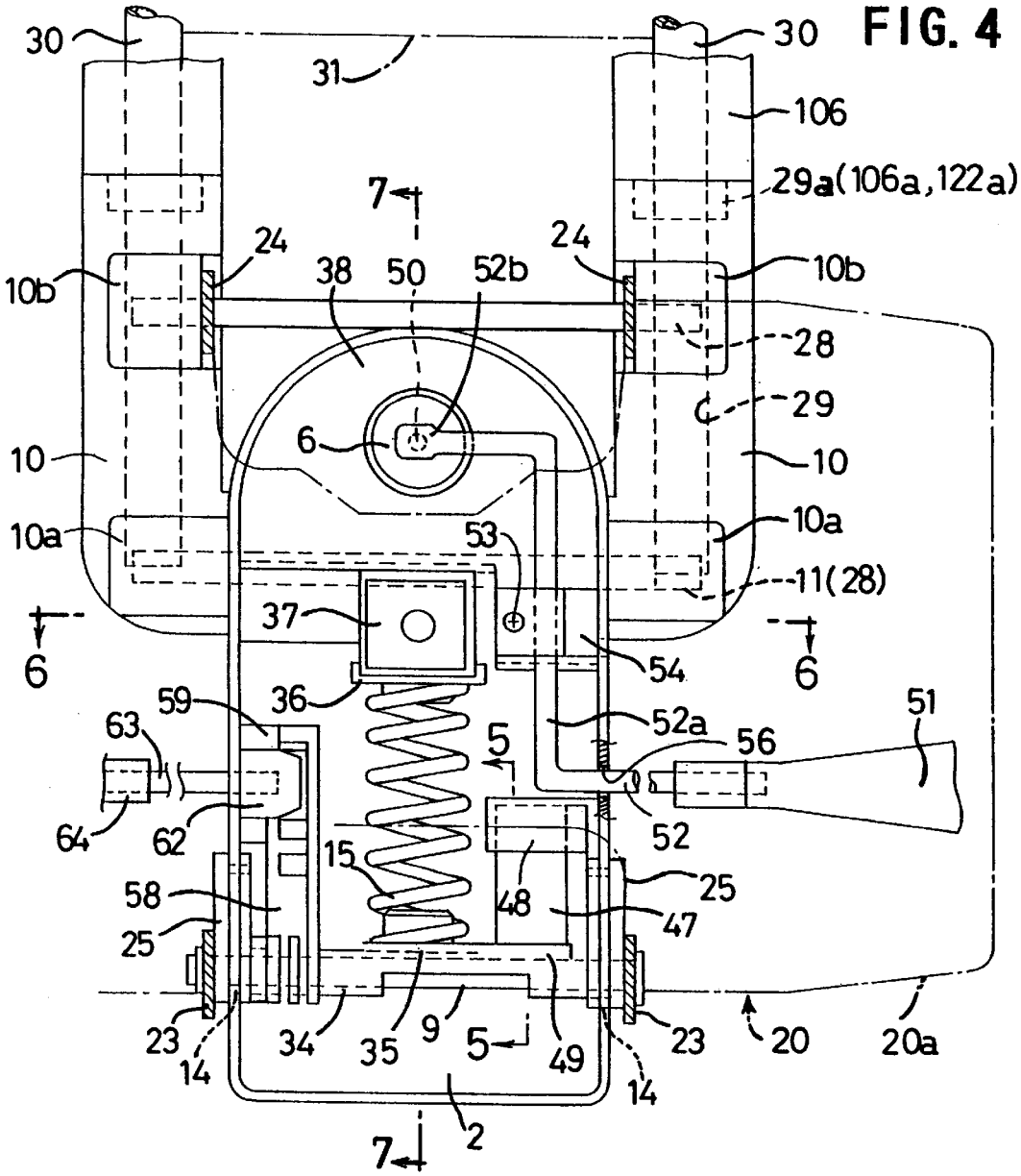
FIG. 4 is a plan view showing the seat with a cushion removed.

As shown in FIGS. 2 and 4 for example, bushes 25 made of a synthetic resin are fitted, from outside, into the respective first shaft-receiving bores 14 of the seat holder 2. Thus, the first shaft 9 is supported by the seat holder 2 via the bushes 25.

As shown in FIGS. 1 and 4, each of the right and the left arms 10 supporting the seat back 4 is formed with upward protrusions 10*a*, 10*b*. In each of the upward protrusions 10*a*, 10*b*, a horizontal hole 28 is formed for receiving the first shaft 13 or the second shaft 11 (see FIG. 4). Each horizontal hole 28 is open only inwards. Thus, the arms 10 are to be fixed to the third shaft 13 and the second shaft 11 from, as viewed laterally, outside of these shafts.

Each of the right and the left arms 10 is also formed with a longitudinal hole 29. This hole is open only backwards for allowing insertion of a joint 30 which may be a pipe. As schematically shown in FIG. 4, the right and the left joints 30 are connected to each other via a horizontal bar 31 (see also FIG. 33). Thus, the arms 10 will not be pulled out from the second shaft 11 nor the third shaft 13 even though the arms are only mounted on these shafts in a simple fitting manner. Further, there is no need to use any pulling-out prevention means such as a snap ring for the second and the third shafts 11, 13. Still further, the arms 10 are made of a synthetic resin. Thus, uncomfortable frictional noises will not be generated in rocking the chair.

A rear portion of each joint 30 is inserted into an outer back member 32 from below. (Detailed description will be given later.)

② Supporting Structure for the Rocking Spring 15

As shown in FIG. 4, a sleeve 34 made of a synthetic resin is fitted on the first shaft 9. The sleeve 34 is integrally formed with a front spring retainer 35 for supporting the front portion of the rocking spring 15. The rocking spring 15 is disposed in a laterally central region of the seat holder 2. The rear portion of the rocking spring is supported by a rear spring retainer 36.

The rear spring retainer 36 is supported by a wedge member 37 which provides a reversed trapezoidal configuration in a side view. The wedge member 37 is supported from behind by a front surface 38*a* of a bracket plate 38 fixed to a rear portion of the seat holder 2. As can be readily seen from FIGS. 8 and 9, the rear spring retainer 36 has a back surface 36*a* which is inclined in parallel to a front surface of the wedge member 37. The front surface 38*a* of the bracket plate 38 is inclined in parallel to a back surface of the wedge member 37.

Figure 8:
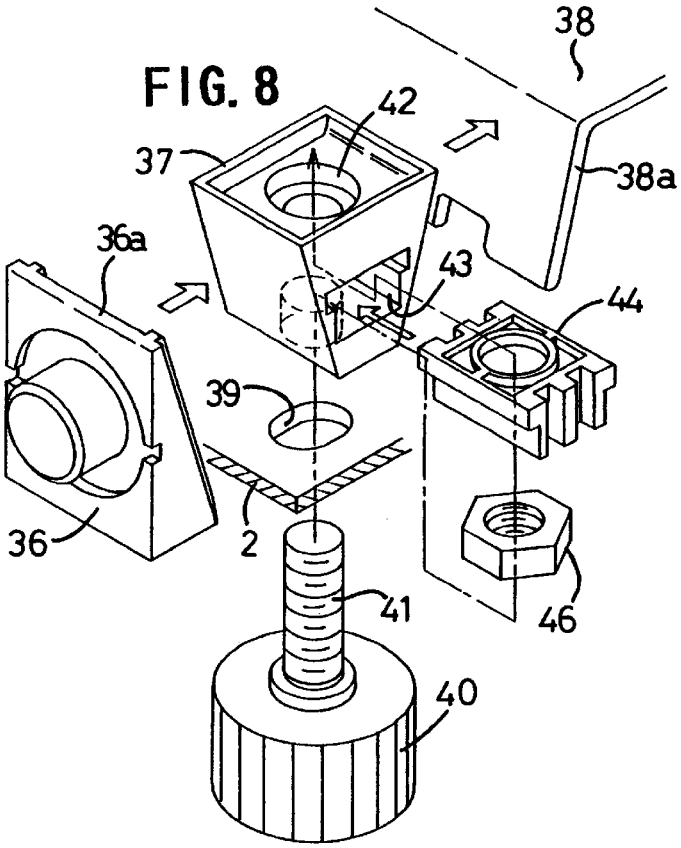
FIG. 8 is an exploded, perspective view illustrating a mechanism for receiving a rocking spring.

A bottom plate of the seat holder 2 is formed with a bolt insertion hole 39 corresponding in position to the wedge member 37 (see FIG. 8). A bolt 41, which is partially embedded into an adjustment knob 40, is inserted into the bolt insertion hole 39 and the wedge member 37.

Figure 10:
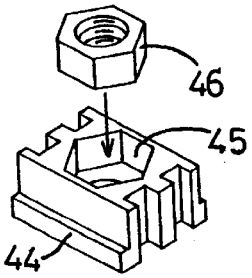
FIG. 10 is an exploded, perspective view showing the lower sides of a nut and a nut holder used for adjusting the initial restoring force of the rocking spring.

The wedge member 37 is provided with a vertical through-hole 42 for permitting insertion of the bolt 41. The wedge member is also provided with a horizontal hollow portion 43, which laterally extends throughout the wedge member and intersects the vertical through-hole 42. Basically, the horizontal hollow portion 43 has a cross section defined by a plurality of straight lines. A nut holder 44 having a similar cross section is inserted into the horizontal hollow portion 43. As shown in FIG. 10, the bottom surface of the nut holder 44 is formed with a hexagonal hole 45 into which a hexagonal nut 46 is fitted.

With such an arrangement, the distance between the bottom plate of the seat holder 2 and the wedge member 37 will be increased or decreased by varying the amount of insertion of the bolt 41 into the nut 46. Correspondingly, the rear spring retainer 36 will be moved backwards or forwards. In this manner, it is possible to adjust the restoring force of the rocking spring 15 in its initial state.

Typically, a wedge member is made of a synthetic resin. Thus, conventionally, a metal nut is embedded in the wedge member itself by insert molding. In this arrangement, however, the metal nut cannot be removed from the wedge member after the chair is scrapped, whereby the synthetic resin wedge member is difficult to recycle.

On the other hand, according to the first embodiment of the present invention, the nut holder 44 can be removed from the wedge member 37 after the chair is scrapped. In this manner, it is possible to easily perform separation of the metal nut 46, the synthetic resin wedge member 37 and the nut holder 44. Thus, the recycling or disposal of the wedge member 37 and the nut holder 44 can be performed efficiently. Alternatively, arrangements may be made for enabling direct insertion of the nut 46 into the horizontal hole 43 of the wedge member 37. According to the first embodiment, the rocking spring 15 is disposed in a laterally central region of the seat holder 2. Such an arrangement is advantageous in preventing the first shaft 9 from being unevenly pressed against the right and the left bushes 25 when the chair is rocked.

③ Rocking Rubber Member 47

Figure 5:
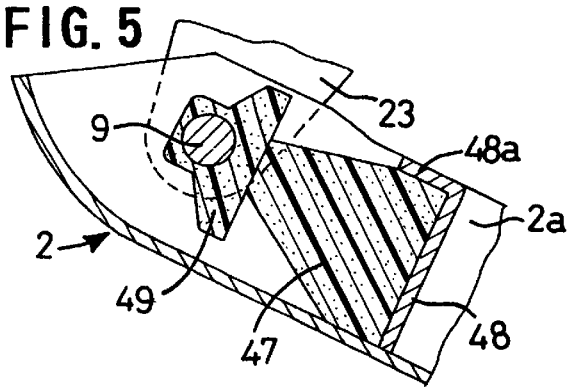
FIG. 5 is a sectional view taken along lines 5—5 in FIG. 4.

As shown in FIGS. 4 and 5, an auxiliary rubber member 47 for assisting the rocking spring 15 is arranged on a side of the rocking spring 15 (the right side, in FIG. 4) in the seat holder 2. The auxiliary rubber member 47 is supported by a rear rubber retainer 48 which is arranged behind the rubber member and fixed to an inner surface of the seat holder 2 by welding for example. The rear rubber retainer 48 is provided with an upper plate 48*a* for restricting the upward movement of the auxiliary rubber member 47.

The sleeve 34 fitted on the first shaft 9 is integrally formed with a front rubber retainer 49 engaged by the front surface of the auxiliary rubber member 47. As shown in FIG. 5 which presents a side elevational view, the auxiliary rubber member 47 is tapered forwards, so that its cross-sectional area becomes smaller toward the front end of the rubber member.

When leaning against the seat back 4, a person's body bends backwards. Thus, the moment applied to the seat back 4 tends to increase more greatly than the backward inclination angle of the seat back 4. In other words, the increase rate of the load acting on the rocking spring 15 tends to be greater than the increase rate of the backward inclination angle of the seat back 4.

A coil spring will be compressed in proportion to the applied load. Thus, when the rocking spring 15 is arranged to exert a restoring force great enough to support the seat back 4 which is leant back to the maximum, the rocking spring will apply an unfavorably strong force to the seat back 4 which is only slightly inclined. On the other hand, when the rocking spring 15 is arranged to exert a restoring force great enough to support the seat back 4 which is only slightly inclined, the rocking spring will apply an unfavorably weak force to the seat back 4 which is leant back to the maximum. Thus, with the use of a coil spring alone, it is difficult to provide an appropriate supporting force at every stage of the backward inclination of the seat back 4.

Here, it should be noted that a rubber member has a compression rate which is smaller than the increase rate of the applied load. Thus, when the auxiliary rubber member 47 is used together with the rocking spring 15 as in the above embodiment, an appropriate supporting force is provided in accordance with the backward inclination of the seat back 4. Thus, it is possible to enjoy comfortable rocking conditions.

In particular, the cross-sectional area of the auxiliary rubber member 47 becomes smaller toward the front end of the rubber member, as previously stated. Such an arrangement is additionally advantageous since the rubber member is readily deformed at an early stage of the backward inclination of the seat back 4 and is less likely to be deformed as the seat back is being inclined backwards to a greater extent. The auxiliary rubber member 47 may be tapered as viewed in plan or be formed into a truncated cone. Further, the auxiliary rubber member may be tapered backwards or have a narrow, intermediate portion as viewed in the front-rear direction.

The backward inclining movement of the seat back 4 may be supported by another elastically supporting means such as an air spring.

⑤ Operating Arrangement of Gas Cylinder 6

As shown in FIG. 4, a push valve 50 for releasing lock projects from the upper surface of the gas cylinder 6. For operating the push valve 50, a height adjustment lever 51 is provided on a side of the seat holder 2. The height adjustment lever 51 is connected to an operation rod 52 which is bent like a crank as viewed in plan.

Figure 6:
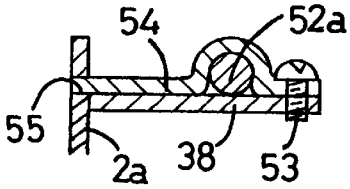
FIG. 6 is part of a sectional view taken along lines 6—6 in FIG. 4.

The operation rod 52 has an elongated portion 52*a* which extends in the front-rear direction and overlaps the upper surface of the bracket plate 38. As shown in FIG. 6, the elongated portion 52*a* of the rod 52 is rotatably supported by a retaining plate 54 which is fixed to the upper surface of the bracket plate 38 by a screw 53. An end portion of the retaining plate 54 is fitted into an opening 55 formed in a side plate 2*a* of the seat holder 2. In this manner, the retaining plate 54 can be positionally fixed only by using the single screw 53.

The operation rod 52 has a flattened end 52*b* which is located above the push valve 50. A base portion 52*c* of the operation rod 52 is caused to project outside via an opening 56 (see FIG. 4) formed in the side plate 2*a* of the seat holder 2.

⑥ Position-changing Mechanism for Seat Back 4

The seat back 4 can be shifted between four positions: a free position in which the seat back 4 can be freely inclined backwards; a first locking position in which the seat back is held in a non-inclined, upright state; a second locking position in which the seat back is held in an intermediately-inclined state; and a third locking position in which the seat back is held in a fully-inclined state. The position-changing mechanism is shown mainly in FIGS. 11–16. Description about it will be given below.

As shown in FIG. 11, the position-changing mechanism for the seat back 4 includes a first locking member 58 fitted on the first shaft 9 and extending backwards, a guide member 59 arranged on the bottom plate of the seat holder 2, a shaft-receiving member 60 arranged between the side plate 2*a* of the seat holder 2 and the guide member 59, a second locking member 61 arranged above the first locking member 58, a plate spring 62 arranged above the second locking member 61, an operation rod 63 having a tip fixed to the second locking member 61, and a lever 64 attached to a base end of the operation rod 63. The lever 64 is shown only partially. The side plate 2*a* of the seat holder 2 is formed with a hole 65 through which the operation rod 63 extends.

The first locking member 58 is provided with five locking holes 66 which are upwardly open and arranged longitudinally of the first locking member. The first locking member 58 has a lower surface which is formed with a guide groove 67 extending in the front-rear direction. Further, the first locking member 58 has a side surface close to the shaft-receiving member 60, in which surface a step portion 68 is formed to extend in the front-rear direction.

The guide member 59 is provided with an inner plate 59*a* on which the guide groove 67 of the first locking member 58 is fitted, and an outer plate 59*b* held in contact with the seat holder 2. The inner plate 59*a* is lower than the outer plate 59*b*.

The guide member 59 has a bottom plate which is formed with a positioning hole 69 elongated in the front-rear direction. Correspondingly, the bottom plate of the seat holder 2 is formed with an upwardly bulging protrusion 70. When the protrusion 70 of the seat holder 2 is fitted into the positioning hole 69, the guide member 59 is fixed in position, so that it will not be moved in the front-rear direction nor in the lateral direction.

The outer plate 59*b* of the guide member 59 is formed with an upward, retreated portion 71 for avoiding interference with the operation rod 63. Further, the outer plate 59*b* is formed with two engaging holes 72 disposed at high positions flanking the retreated portion 71.

Further, the outer plate 59*b* of the guide member 59 is provided with an inward nail 73 which comes into contact with the upper surface of the step portion 68 of the first locking member 58. The inward nail is formed by a cut-and-bend method. The first locking member 58 is moved in the front-rear direction together with the first shaft 9. While being thus moved, lateral deviation of the first locking member is restricted by the inner plate 59*a* of the guide member 59, whereas upward bouncing is restricted by the inner nail 73 of the guide member 59.

The shaft-receiving member 60 has a back surface which is integrally formed with a tubular portion 74 fitted into the hole 65 of the seat holder 2. The end surface of the tubular portion 74 is inclined so that the tubular portion becomes greater in height as viewed from bottom to top.

Figure 14:
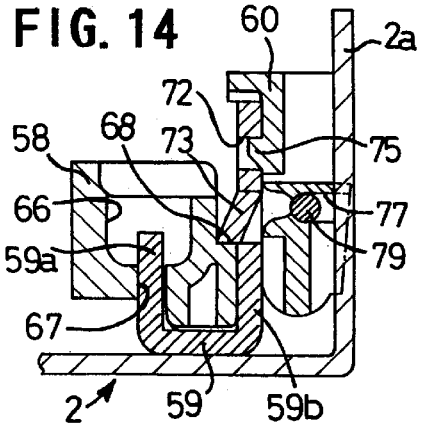
FIG. 14 is a sectional view taken along lines 14—14 in FIG. 13.

The shaft-receiving member 60 has a configuration suitable for covering the outer plate 59*b* of the guide member 59 from above. Further, the shaft-receiving member 60 is provided with pins 75 fitted into the engaging holes 72 of the guide member 59, a retreated portion 76 corresponding to the retreated portion 71 of the guide member 59, and a shaft-receiving groove 77 extending transversely of the retreated portion 76. As shown in FIG. 14, a lower portion of each pin 75 is partially cut out to provide a diagonal surface.

Since each pin 75 has a diagonal lower surface and the end surface of the tubular portion 74 is arranged to taper, as stated above, the shaft-receiving member 60 can be inserted between the side plate 2*a* of the seat holder 2 and the guide member 59 from above. In this manner, the shaft-receiving member 60 is positionally fixed so that it will not move upward.

The second locking member 61 has paired locking nails 78 which are simultaneously inserted into the locking holes 66 of the first locking member 61. The locking nails 78 are spaced from each other by a predetermined distance, so that the locking nails 78 come into engagement with two of the five locking holes 66 with only one intervening hole between the two.

The second locking member 61 has a side surface to which a rotation shaft 79 is welded. This rotation shaft is fitted into the shaft-receiving groove 77 of the shaft-receiving member 60. The operation rod 63 is fixed to a lower surface of the second locking member 61 by a screw 80.

Figure 15:
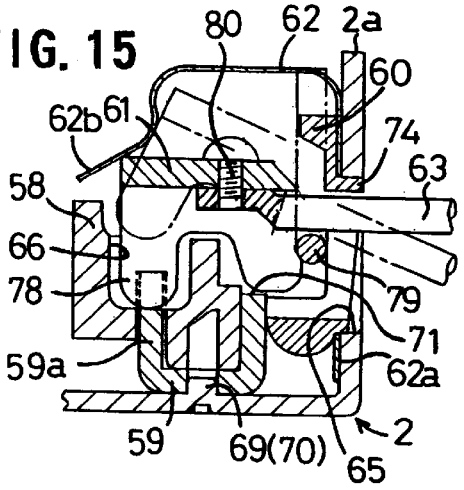
FIG. 15 is a sectional view taken along lines 15—15 in FIG. 13.
Figure 16:
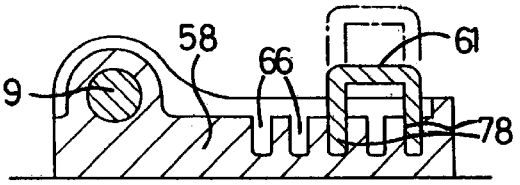
FIG. 16 is a sectional view taken along lines 16—16 in FIG. 13.
Figure 17:
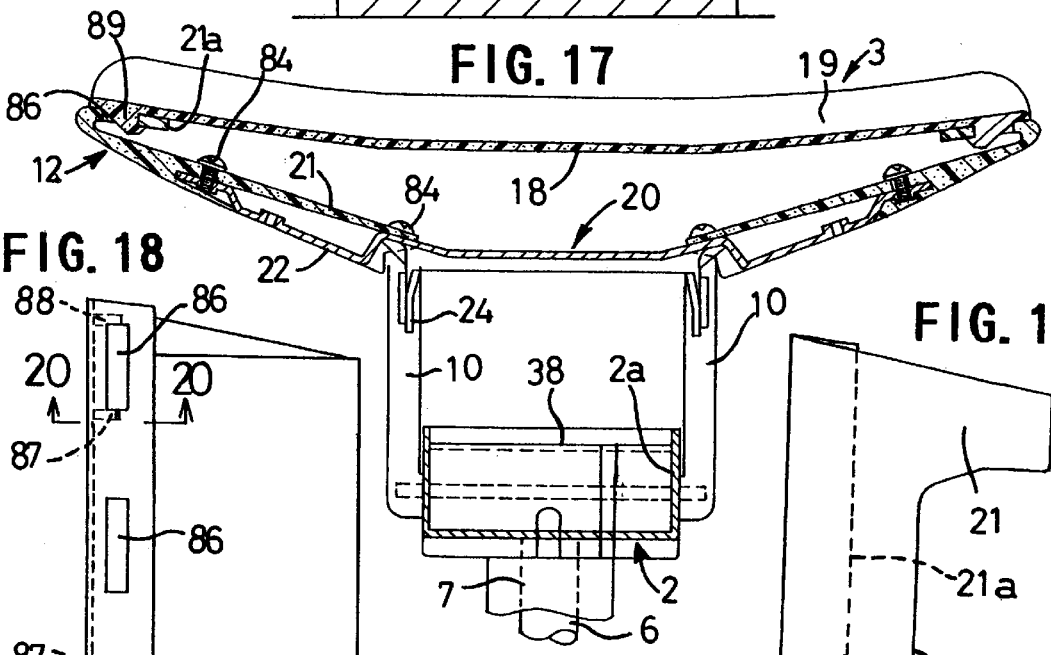
FIG. 17 is a sectional view taken along lines 17—17 in FIG. 1.

As can be easily seen from FIG. 15, when the operation shaft 63 is caused to pivot vertically, the second locking member 61 will pivot on the rotation shaft 79. As a result, the locking nails 78 of the second locking member 61 are brought into or out of engagement with the locking holes 66 of the first locking member 58.

The plate spring 62 is provided for keeping the second locking member 61 in a proper position. The plate spring 62 has an end portion 62*a* inserted between the side plate 2*a* of the seat holder 2 and the shaft-receiving member 60. The end portion 62*a* is formed with an elongated hole 81 (see FIG. 11) which is fitted on the tubular portion 74 of the shaft-receiving member 60. Thus, the plate spring 62 can be held in place without being unduly pulled out.

The plate spring 62 also has a tongue-like end portion 62*b* which is bent and extends downwardly. The end portion 62*b* is rendered small enough in width so that it can be fitted between the front and the rear locking nails 78 of the second locking member 61.

As shown by solid lines in FIG. 15, when the second locking member 61 is held in engagement with the first locking member 58, an edge of the second locking member 61 is pressed by the tongue-like end portion 62*b* of the plate spring 62. Thus, the locked state is maintained. When the second locking member 61 is caused to pivot upward to release the locked state as shown by single-dot chain lines in FIG. 15, the tongue-like end portion 62*b* of the plate spring 62 is positioned between the front and the rear locking nails 78 of the second locking member 61. As a result, an unlocked state is maintained.

The second locking member 61 is fitted into the retreated portion 76 of the shaft-receiving member 60. Thus, the load applied in a locked state is supported by side surfaces of the retreated portion 76 of the shaft-receiving member 60.

⑦ Outer Seat Member 12

Description will now be given to the structure of the outer seat member 12 of the present invention with reference to FIGS. 17–22.

Figure 18:
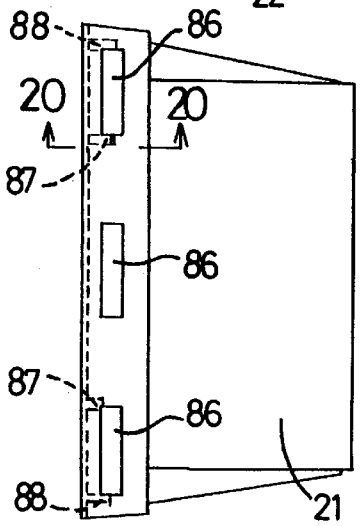
FIG. 18 is a plan view showing an auxiliary supporting element constituting the outer seat member.
Figure 19:
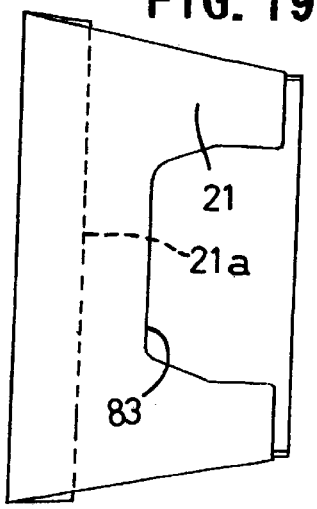
FIG. 19 is a bottom view showing the auxiliary supporting element constituting the outer seat member.
Figure 22:
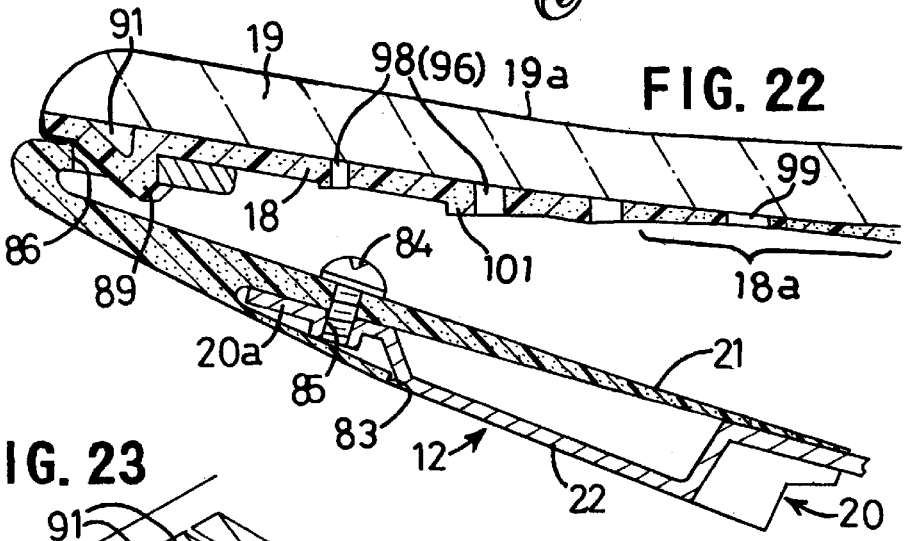
FIG. 22 is an enlarged view of a part shown in FIG. 17.

As shown in FIGS. 17–22, the auxiliary supporting elements 21 of the outer seat member 12 are provided with a bag-like portion to be fitted on the spanning portion 20*a* of the base 20. As shown in FIGS. 19 and 22 for example, the bottom surface of the auxiliary supporting element 21 is provided with a cutout (shown by reference numeral 83) which is large enough to avoid interference with the dent 22 of the base 20. The auxiliary supporting element 21 has an upper surface which is formed with holes 85 for allowing insertion of fixation screws 84.

The auxiliary supporting elements 21 of the outer seat member 12 are made of a synthetic resin such as polypropylene by injection molding.

The auxiliary supporting element 21 is provided at its edge with an eaves-like supporting portion 21*a* overlapping the side edge of the inner seat member 18. Thus, the above-mentioned edge of the auxiliary supporting element 21 has a J-shaped cross section. The supporting portion 21*a* of the auxiliary supporting element 21 is formed with three rectangular engagement holes 86 located in a front, an intermediate and a rear areas of the supporting portion. The engagement holes 86, which serve as a part of the claimed engaging means, are used for fixing the inner seat member 18. The number and the geometry of the engagement holes 86 may be modified as required.

The right and left ends of the auxiliary supporting elements 21 project externally from the base 20. The projecting portion is arranged to become smaller in thickness toward its end, so that it can elastically deform to a certain extent. The supporting portion 21*a* of the auxiliary supporting element 21 is also deformable in its root area.

Figure 20:
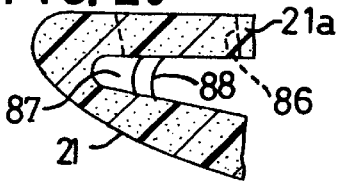
FIG. 20 is a sectional view taken along lines 20—20 in FIG. 18.
Figure 21:
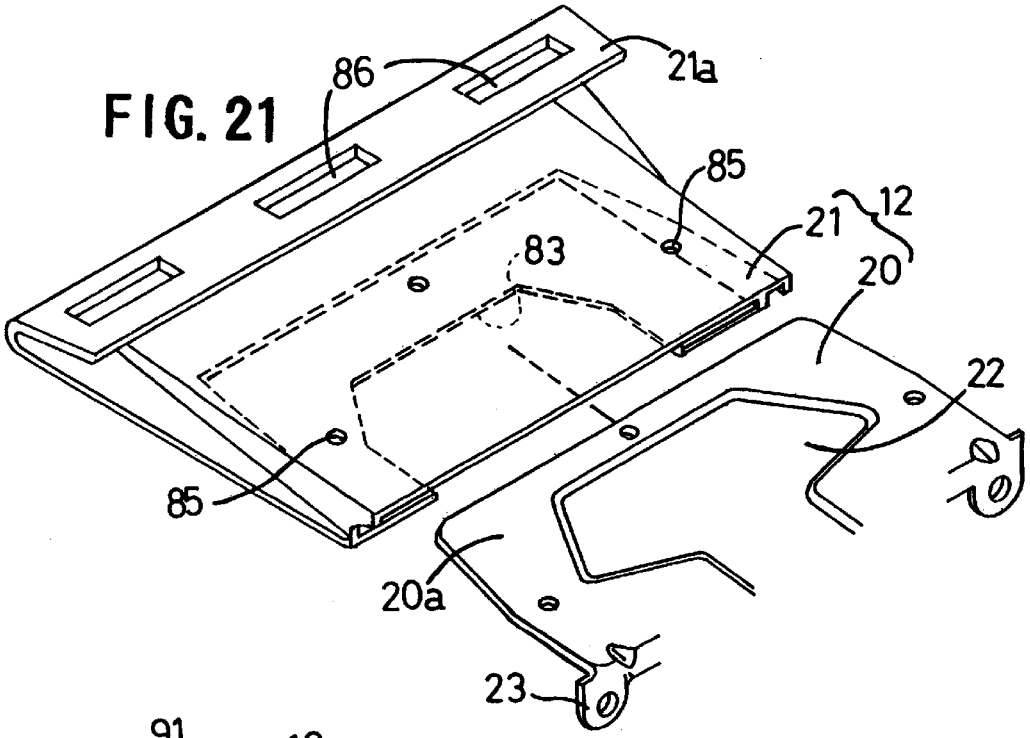
FIG. 21 is a perspective view showing the base of the outer seat member and the auxiliary supporting element which are detached from each other.

As shown in FIGS. 18 and 20, two pairs of ribs 87, 88 are provided to flank the front and the rear engagement holes 86. Owing to the presence of the ribs 87 and 88, the supporting portion 21*a* is prevented from being excessively deformed. As can be easily seen from FIG. 20, the outer ribs 88 are rendered to project to a greater extent than the inner ribs 87.

Thus, the supporting portion 21*a* of the auxiliary supporting element 21 will hardly be deformed in its front and rear side areas. In such an arrangement, when a person puts his or her finger, for some reason, into a clearance defined by the supporting portion 21*a* of the auxiliary supporting element 21, the finger will not be injured from being pinched.

In the above embodiment, the auxiliary supporting element 21 is provided with a bag-like portion. Such an arrangement is advantageous in increasing the strength of the auxiliary supporting element. Also, since the fixation screws 85 are hidden, a person will not be injured by the screws 85 even when he or she accidentally touches the bottom surface of the auxiliary supporting elements 21. Further, when the fixation screws 84 may come off for some reason, the auxiliary supporting elements 21 are kept to be fixed to the base 20, which is advantageous in ensuring safety.

⑧ Inner Seat Member 18

Description will now be given to the structure of the inner seat member 18 with reference to FIGS. 22–28.

The inner seat member 18 is made of a synthetic resin such as polypropylene by injection molding. The inner seat member 18 is generally flat, but slightly warped to fit the contours of person's buttocks and thighs.

The inner seat member 18 is provided, at each of its right and left ends, with three engagement nails 89 projecting downwardly. The engagement nails 89 serve as a part of engaging means set forth in claim 4. When forced down into the engagement holes 86 of the auxiliary supporting elements 21, the engagement nails are elastically deformed to be fitted into the engagement holes 86. In this manner, the inner seat member 18 can be attached to the auxiliary supporting elements 21 instantly.

Figure 23:
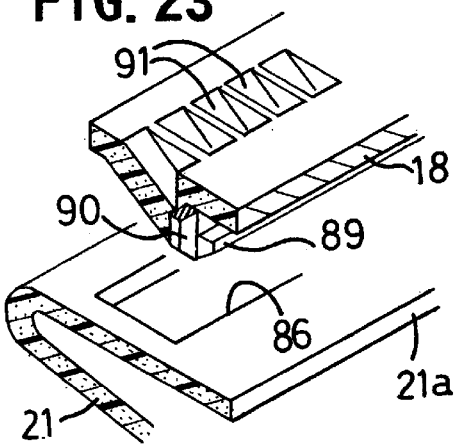
FIG. 23 is an exploded, perspective view showing, partly in section, the inner seat member and the outer seat member.
Figure 24:
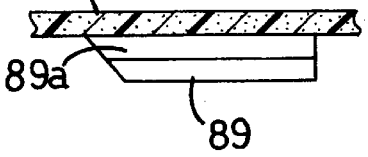
FIG. 24 illustrates a modified engagement nail for the inner seat member.
Figure 25:
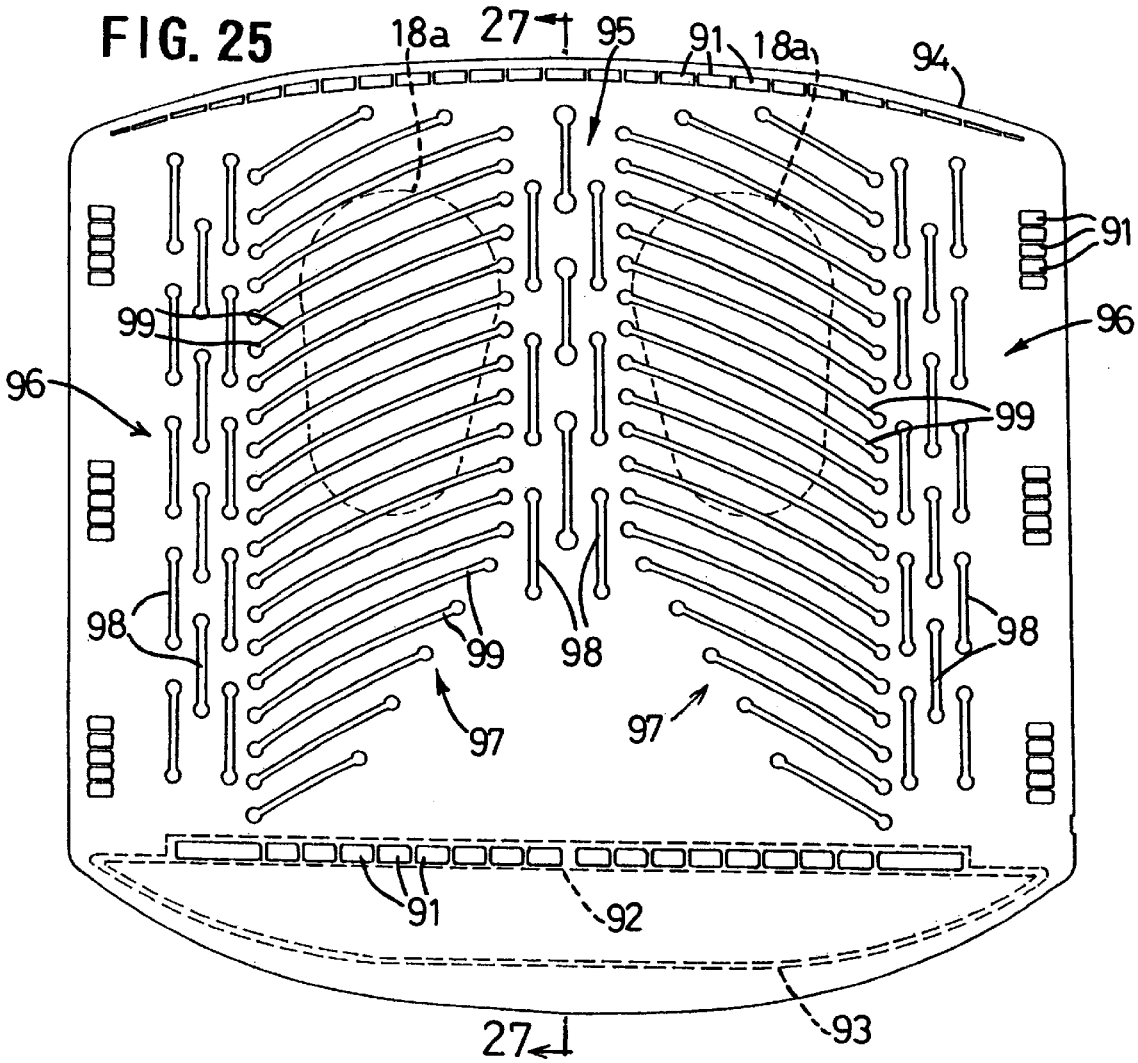
FIG. 25 is a plan view showing the inner seat member.
Figure 26:
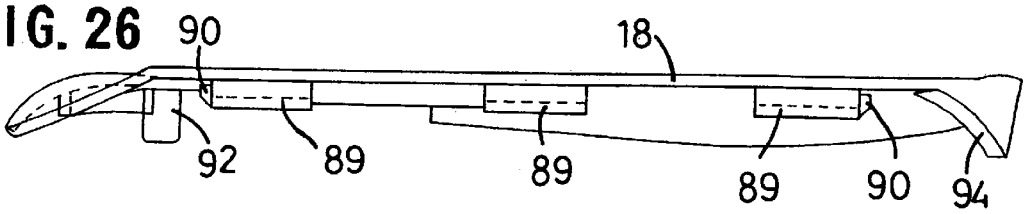
FIG. 26 is a right side view showing the inner seat member.

As shown in FIGS. 23 and 26, slanting ribs 90 are provided in front of the front engagement nail 89 and behind the rear engagement nail 89 for guiding the fitting operation to the engagement holes 86. Instead of using the slanting ribs 90 for guiding means of the engagement nails 89, the entire side surface 89*a* of the respective engagement nails 89 may be inclined, as shown in FIG. 24.

As clearly shown in FIG. 23, the inner seat member 18 is provided with upwardly open grooves 91 which are spaced from each other at suitable intervals and arranged to correspond in position to each of the engagement nails 89. These grooves are provided for equalizing the thickness adjacent to the engagement nails 89. With such an arrangement, positional accuracy will be maintained when the resin material contracts during a forming process. It should be noted that the grooves 91 are covered by the cushion 19, thereby eliminating the problem of spoiling the appearance.

Figure 27:
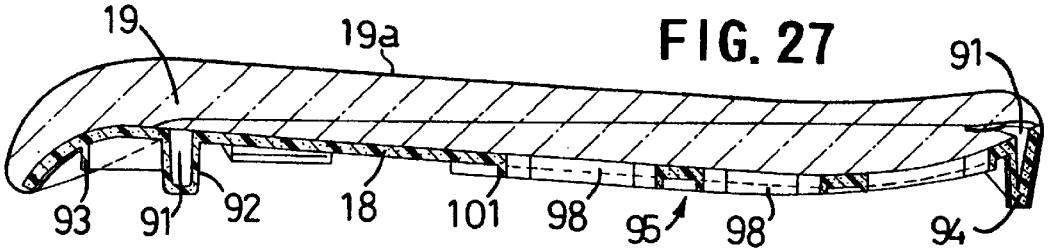
FIG. 27 is a sectional view taken along lines 27—27 in FIG. 25, illustrating the inner seat member with a cushion mounted thereon.

As shown in FIG. 27, the inner seat member 18 is provided with a laterally-extending, front reinforcement rib 92 arranged in a front portion of the lower surface of the inner seat member. Thus, the front portion of the lower surface is less susceptible to deformation. The reinforcement rib 92 is also formed with a plurality of grooves 91 arranged at suitable intervals.

The lower surface of the inner seat member 18 is formed with a projecting auxiliary rib 93. The auxiliary rib is arranged ahead of the front reinforcement rib 92 while extending to be connected to the reinforcement rib 92. The front auxiliary rib 93 is provided for adjusting the edge of a cloth 19*a* used to cover the cushion 19. (The edge of the cloth 19*a* is properly cut by a cutter (not shown) which can be moved along the auxiliary rib 93 with the cutting edge of the cutter held in contact with the root portion of the auxiliary rib 93.)

As clearly shown in FIG. 27 for example, the inner seat member 18 is provided, at a rear end thereof, with a rear reinforcement rib 94. Thus, the rear end of the inner seat member 18 is hardly deformed. The rear reinforcement rib 94 is also formed with a plurality of grooves 91.

The inner seat member 18 is formed with a center slit group 95, right and left side slit groups 96, and main slit groups 97 arranged between the center slit group and the side slit groups. The center slit group 95 and the side slit groups 96 correspond to the claimed first slit groups, whereas the main slit groups 97 correspond to the claimed second slit groups.

The center slit group 95 and the side slit groups 96 are made up of a plurality of unit slits 98 each extending in the front-rear direction. These unit slits are divided into a plurality of rows which are laterally spaced. In each row, unit slits are spaced from each other. Any two laterally adjacent unit slits 98 are offset from each other in the front-rear direction.

The main slit groups 97 are made up of unit slits 99 each of which extends slantingly forward away from the center of the inner seat member 18 (each of the unit slits 99 is slightly curved in a convex form pointing obliquely backward). Thus, The center slit group 95 and the main slit groups 97 resemble in arrangement a spine and ribs.

Each of the side slit groups 96, as a whole, extends from a location near a front reinforcement ribs 92 to another location near a rear reinforcement ribs 94. The center slit group 95 is arranged in a backwardly offset region. The unit slits 99 in each of the main slit groups 97 have laterally outer ends arranged in a line. Some of the unit slits 99 located ahead of the center slit group 95 become smaller in length as going forwardly. Thus, there is a generally triangular space provided with no slits in front of the center slit group 95.

The main slit groups 97 have several unit slits 99 arranged in a rear region. These rear unit slits 99 become smaller in length as going backward.

The inner seat member 18 includes relatively thinner portions (indicated by closed broken lines in FIG. 25 or by closed solid lines in FIG. 28) to which the ischia of a person correspond in position. These portions, which may be referred to as "easy-to-deform zones 18*a*" below, can be deformed elastically more easily than the other portions of the inner seat member. Each of the unit slits 98, 99 has rounded ends in order to prevent possible breakage due to stress concentration.

The unit slits 98 of the center slit group 95 and side slit groups 96 extend in the front-rear direction. Thus, when a person sits on the chair, the regions corresponding to the center slit group 95 and side slit groups 96 are elastically deformed to expand laterally. At the same time, the regions corresponding to the main slit groups 97 are deformed to expand mainly in a direction perpendicular to the unit slits 99.

Due to the above differences in structure and thickness of the slits, the portions of the inner seat member 18 for supporting the person's ischia are elastically deformed to sag to a greater extent while the portions coming into contact with the thighs are deformed only to a smaller extent. Thus, the person's weight can be supported by the inner seat member 18 in a uniformly distributed manner. In other words, the person feels no stress applied only to a particular portion of his or her body. Therefore, the person is able to keep sitting on the chair comfortably for a long time.

When a person sits on a chair, he or she may sit back on the chair or sit lightly by shifting the position of his or her body in the front-rear direction. According to the above embodiment, the easy-to-deform zones 18*a* are elongated in the front-rear direction. Thus, whichever position the person may take on the chair, he or she will find his or her body comfortably fitting the chair.

Figure 28:
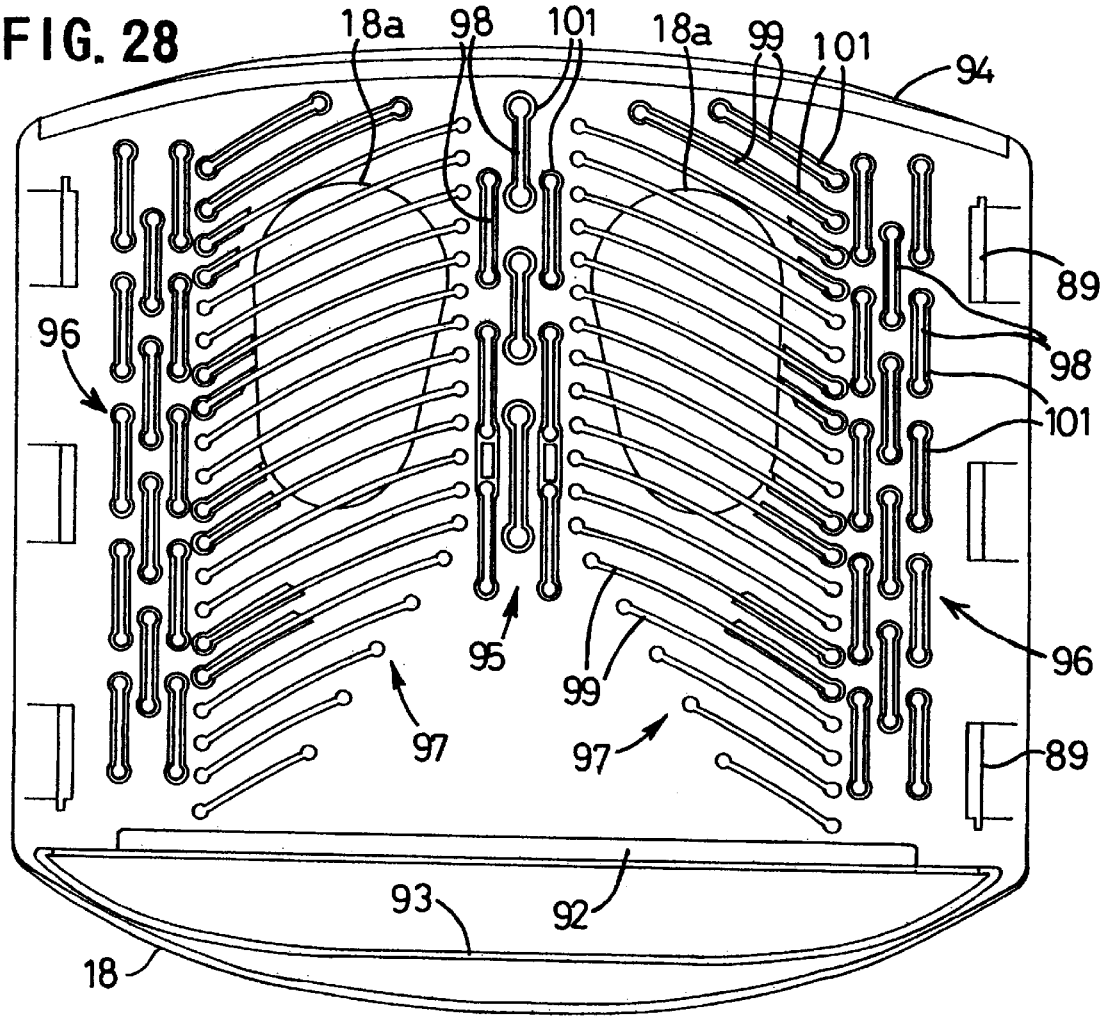
FIG. 28 is a bottom view showing the inner seat member.
Figure 29:
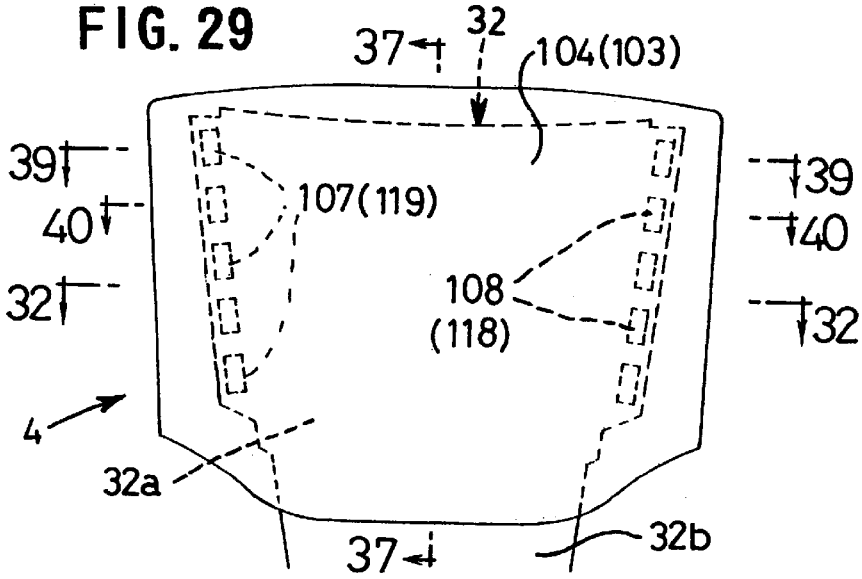
FIG. 29 is a front view showing the seat back.
Figure 30:
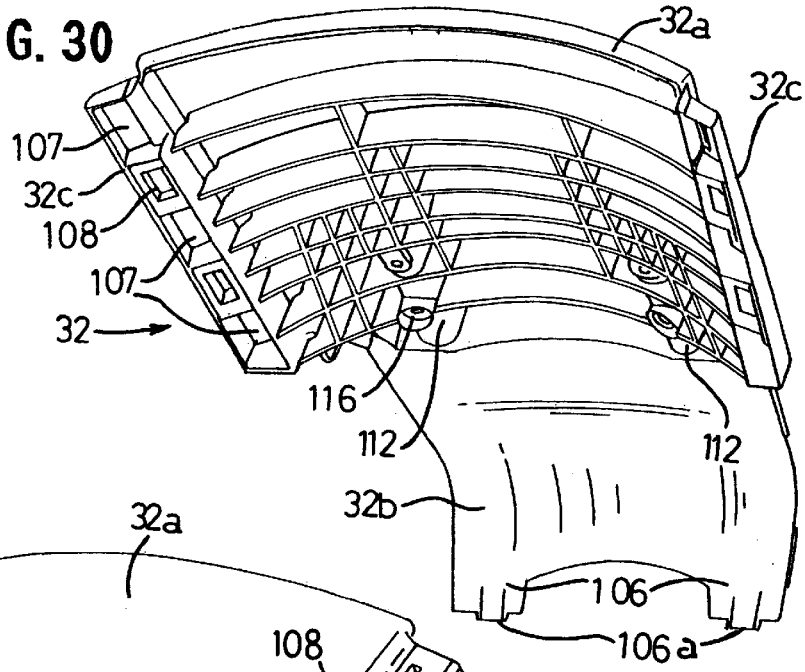
FIG. 30 is a perspective view showing the front side of an outer back member.

As shown in FIGS. 27 and 28, use is made of reinforcement ribs 101 for the peripheries of the respective unit slits 98 of the center slit group 95 and side slit groups 96. Further, additional reinforcement ribs 101 are provided for part of the unit slits 99 of the main slit groups 97. With the use of these reinforcement ribs 101, the width of the respective unit slits 98, 99 will not become unduly large. Thus, it is possible to prevent breakage of the inner seat member 18. Also, the easy-to-deform zones 18*a* can be deformed intensively, thereby providing an excellent snug-fitting condition.

All of the unit slits 98 of the center slit group 95 and side slit groups 96 are provided with reinforcement ribs 101. This arrangement is made because the unit slits 98 extend in the front-rear direction and therefore tend to be laterally deformed to a great extent when a person sits on the chair.

⑨ Outer Back Member 32

Description will now be given to the seat back.

The seat back is made up of a shell-like outer seat member 32, an inner back member 103, a cushion 104 and a rear cover 105.

As shown in FIGS. 1, 30, 31 and 33, the outer back member 32 is provided with a primary portion 32*a* for supporting the inner back member 103 from behind, and a leg portion 32*b* extending slantingly downward from the lower end of the primary portion. The leg portion 32*b* is formed, at its lower end, with fitting elements 106 which have an arcuate cross-sectional configuration and partially overlap the joints 30.

The primary portion 32*a* of the outer seat member 32 is slightly warped outward in a convex manner as viewed in plan. The primary portion 32*a* is formed, at its right and left edges, with supporting elements 32*c* overlapping the inner back member 103. The supporting elements 32*c* have a trapezoidal configuration as viewed in plan.

Each of the supporting elements 32*c* is formed with three first retreated portions 107 which are open forwardly, and two second retreated portions 108 which are open backwardly. The first and the second retreated portions are alternately arranged. Each of the first retreated portions 107 has a bottom wall formed with a first engagement hole 109, whereas each of the second retreated portions 108 has a bottom wall formed with a second engagement hole 110. The engagement holes 109, 110 serve as a part of the claimed engaging means.

Figure 32:
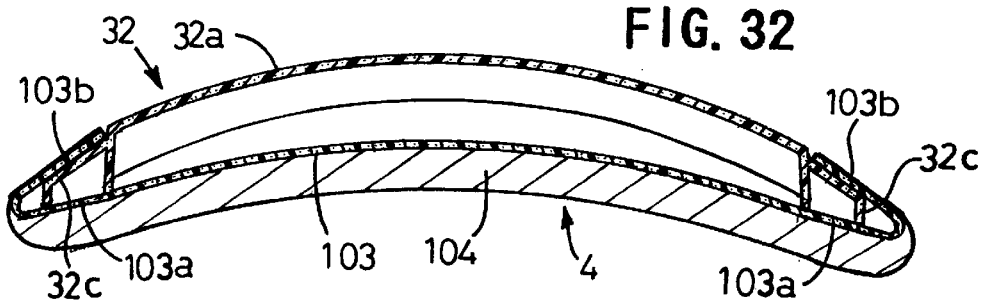
FIG. 32 is a sectional view taken along lines 32—32 in FIG. 29.
Figure 33:
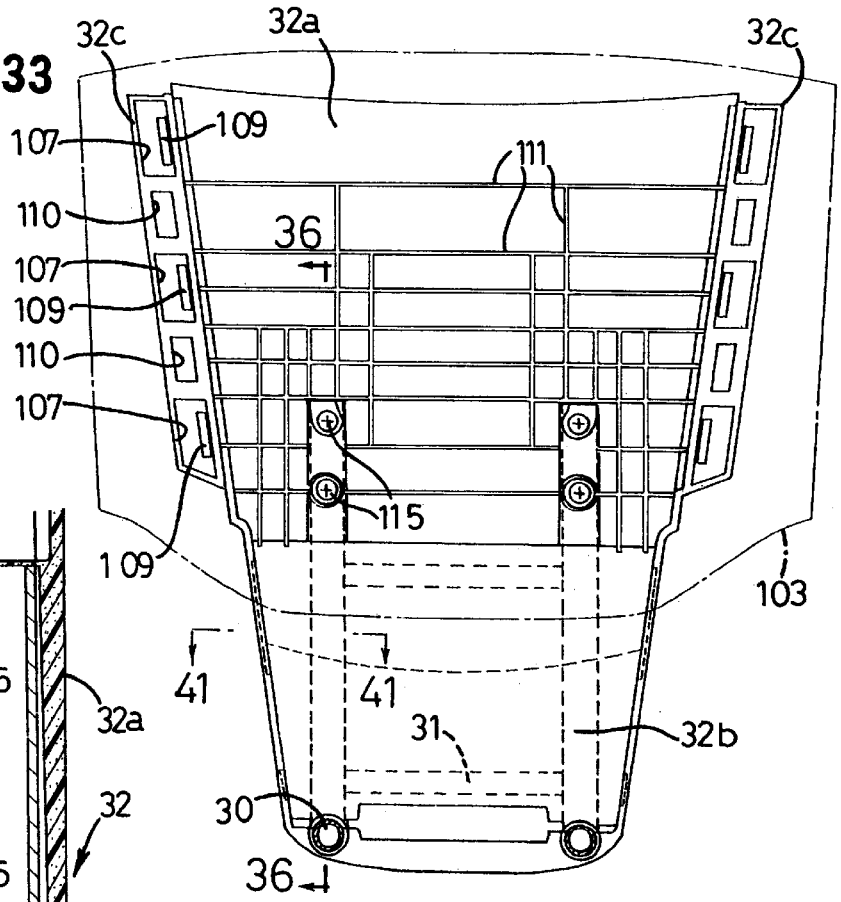
FIG. 33 is a front view showing the outer back member.

Between the right and the left supporting elements 32*c*, the primary portion 32*a* of the outer back member 32 is warped outwardly in a convex manner as viewed in plan (see FIG. 32). The front surface of the primary portion is formed with a plurality of reinforcement ribs 111 which extend horizontally and vertically in an intersecting manner.

Figure 31:
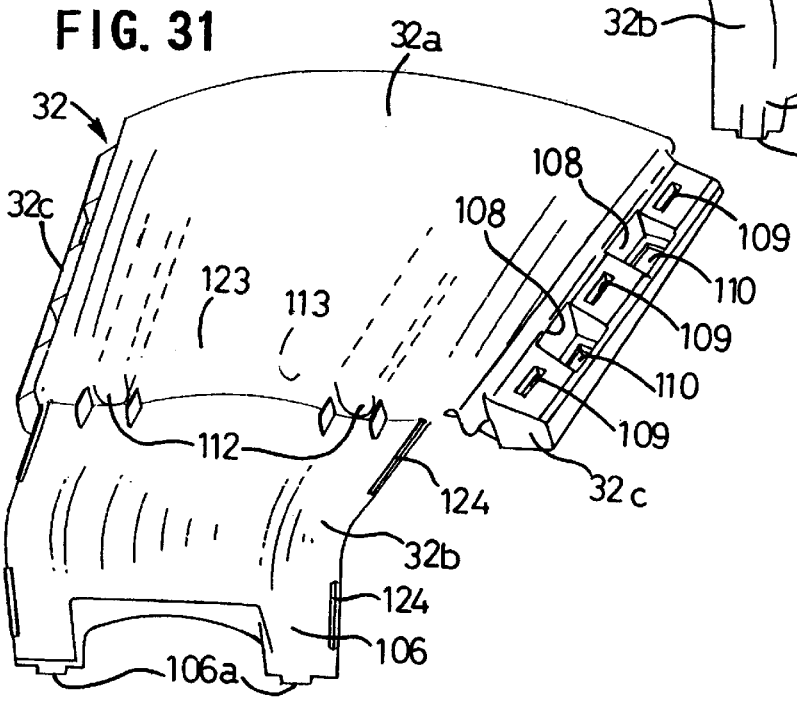
FIG. 31 is a perspective view showing the rear side of the outer back member.

In the outer back member 32, as can be easily seen from FIG. 31 for example, the back surface of the primary portion 32*a* and the leg portion 32*b* are disposed unevenly. The front surface of the primary portion 32*a* is formed with a pair of right and left tubular elements 112 into which the joints 30 are fitted. The tubular elements 112 are open downwardly in a step surface 113 which is disposed between the primary portion 32*a* and the leg portion 32*b*.

Figure 36:
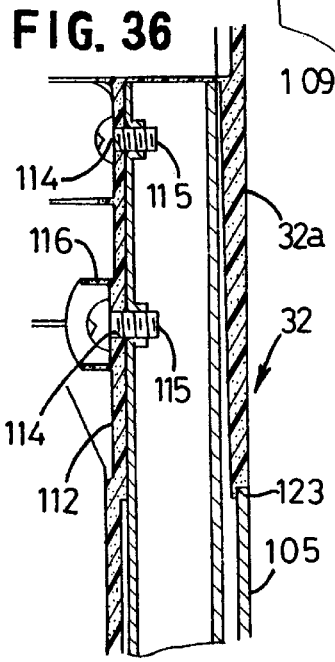
FIG. 36 is a sectional view taken along lines 36—36 in FIG. 33.

As shown in FIG. 36, the tubular elements 112 are provided with screw insertion holes 114 for allowing insertion of screws 115. After inserted into the screw insertion holes 114, the screws 115 are pressed into the joints 30 so that the outer back member 32 is fixed to the joints 30. The heads of the lower screws 115 are surrounded by circular ribs 116. The circular ribs 116 can also serve as a reinforcement.

⑩ Inner Back Member

Figure 37:
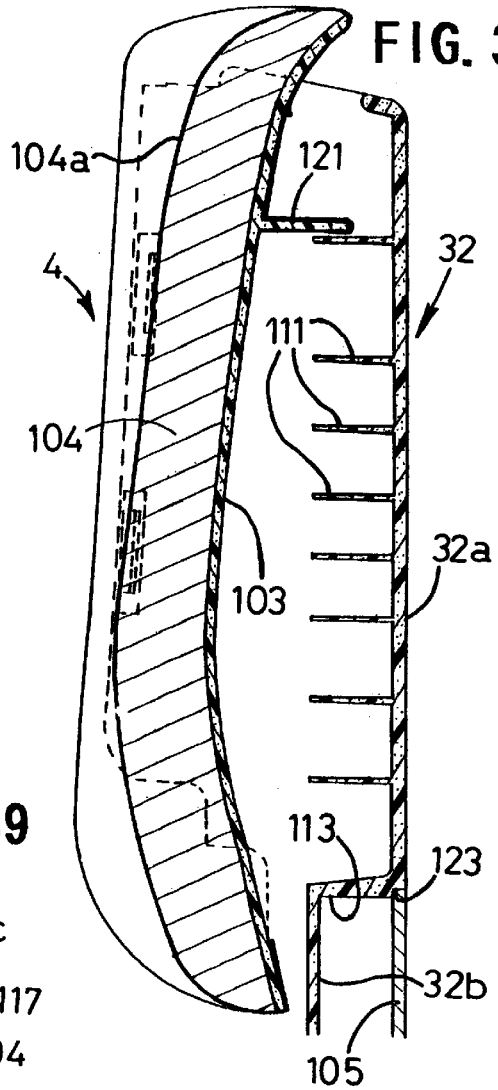
FIG. 37 is a sectional view taken along lines 37—37 in FIG. 29.

The inner back member 103 is larger than the primary portion 32*a* of the outer back member 32. As shown in FIG. 37, the inner back member has a forwardly convex cross section.

Figure 38:
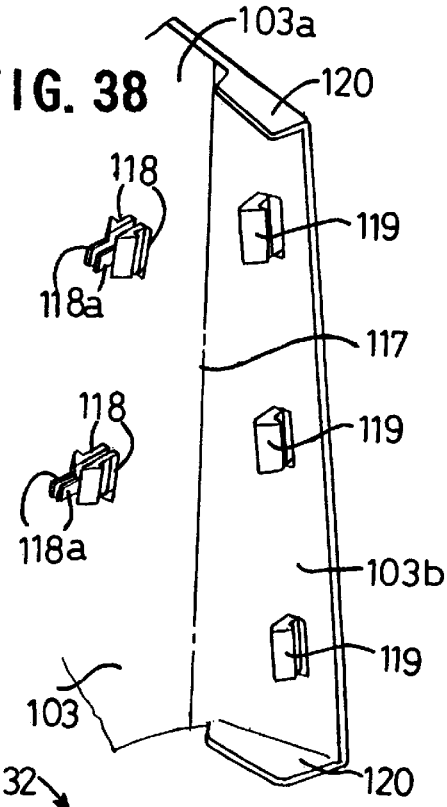
FIG. 38 is a perspective view showing part of the rear side of the inner back member.

As shown in FIGS. 34 and 38–40, the inner back member 103 is formed with overlapping portions 103*a* which are overlapped by the supporting elements 32*c* of the outer back member 32. The overlapping portions 103*a* are formed integrally with embracing portions 103*b* which can be folded back to the rear sides of the supporting elements 32*c* of the outer back member 32. In FIG. 38, reference numeral 117 shows a line at which the embracing portion 103*b* is to be folded.

Figure 39:
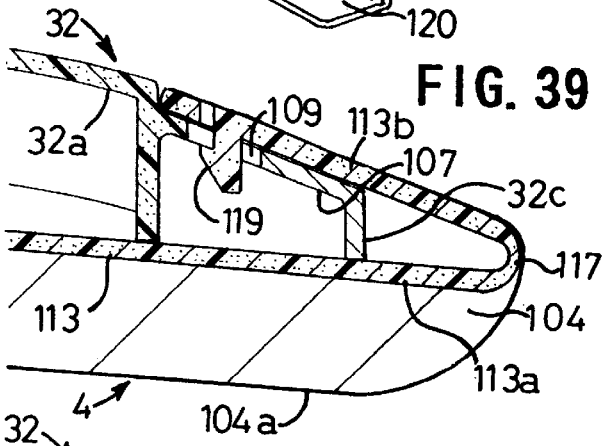
FIG. 39 is a sectional view taken along lines 39—39 in FIG. 29.
Figure 40:
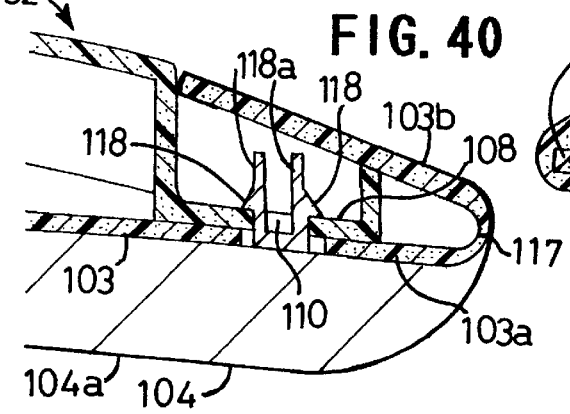
FIG. 40 is a sectional view taken along lines 40—40 in FIG. 29.

As shown in FIGS. 38 and 40, the overlapping portions 103*a* of the inner back member 103 are formed, at their rear surface, with second engagement nails 118 to be fitted into second engagement holes 110 of the outer back member 32. As shown in FIGS. 38 and 39, the embracing portions 103*b* of the inner back member 103 are formed with first engagement nails 119 to be fitted into the first engagement holes 109 of the outer back member 32 from behind.

The second engagement nails 118 are used as a pair of right and left nails which are held in engagement with the first engagement holes 110, as shown in FIG. 40. The second engagement nails 118 are formed integrally with a protrusion 118*a*. Thus, after the second engagement nails 118 were fitted into the first engagement holes 110, the second engagement nails 118 can easily be pulled out of the first engagement holes 110 by pinching the paired protrusions 118*a* and reducing the distance therebetween with the use of pliers (not shown).

As shown in FIG. 38, the embracing portions 103*b* of the inner back member 103 are formed, at their upper and lower ends, with ribs 120. These ribs will overlap right and left sides of the inner back member 103 when the embracing portions 103*b* are folded back. In this manner, the ribs 120 serve to accurately define the folding line 117. Further, the ribs 120 can cover the supporting elements 32*c* of the outer back member 32 from above and below, which is advantageous in providing a good appearance.

As shown in FIG. 37, the inner back member 103 is provided, at an upper portion of its rear surface, with a horizontal rib 121 located above the uppermost reinforcement rib 111 of the outer back member 32. The horizontal rib 121 serves as a stopper for preventing the inner back member 103 from deforming excessively while also serving as a cover for closing the gap between the inner back member 103 and the outer back member 32.

In the inner back member 103, only its right and left portions are fixed to the outer back member 32, so that a space is present between the inner back member 103 and the outer back member 32. With such an arrangement, when a person sits on the chair and leans back on the seat back 4, the inner back member 103 is deformed to fit the person's back.

In order to allow the inner back member 103 to deform elastically, a space which is open upward and downward is provided between the inner back member 103 and the outer back member 32. In this arrangement, a thing may accidentally fall into the space. In view of this, the horizontal rib 121 is disposed at a position allowing grown-ups to reach the horizontal rib. Thus, a thing fallen into the space can easily be picked up .

Figure 34:
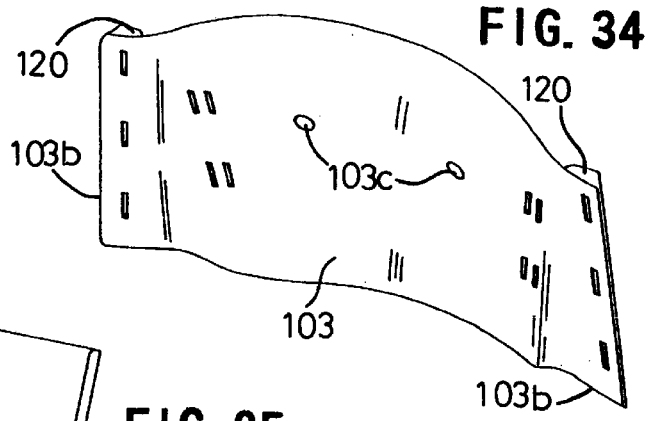
FIG. 34 is a perspective view showing an inner back member.
Figure 35:
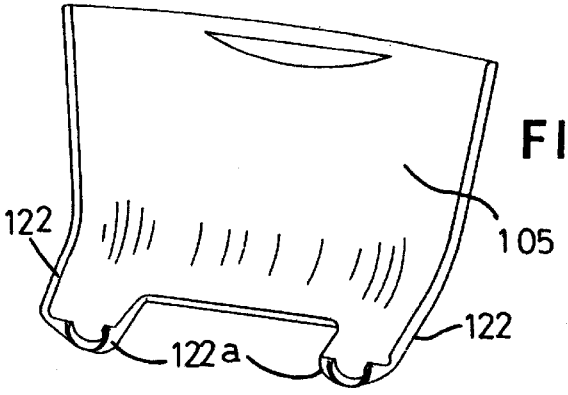
FIG. 35 is a perspective view showing a rear cover for the seat back.

According to the above embodiment, the engagement nails 118, 119 are fitted into the supporting elements 32*c* of the outer back member 32 from before and behind. Such an arrangement is advantageous because the inner back member 103 can firmly be held in position. Further, in the above embodiment, use is made of engaging means including the engagement nails 118, 119 and the engagement holes 108, 109. In this way, an assembling procedure can easily be performed. As shown in FIG. 34, the inner back member 103 is advantageously formed with ventilation holes 103*c* for facilitating compression of the cushion 104.

⑪ Rear Cover 105

As shown in FIG. 1, the rear cover 105 has a configuration suitable for overlapping the leg portion 32*b* of the outer back member 32 from behind. The rear cover is provided, at its lower end, with semi-circular fitting portions 122 to be fitted on the joints 30 from below.

Figure 7:
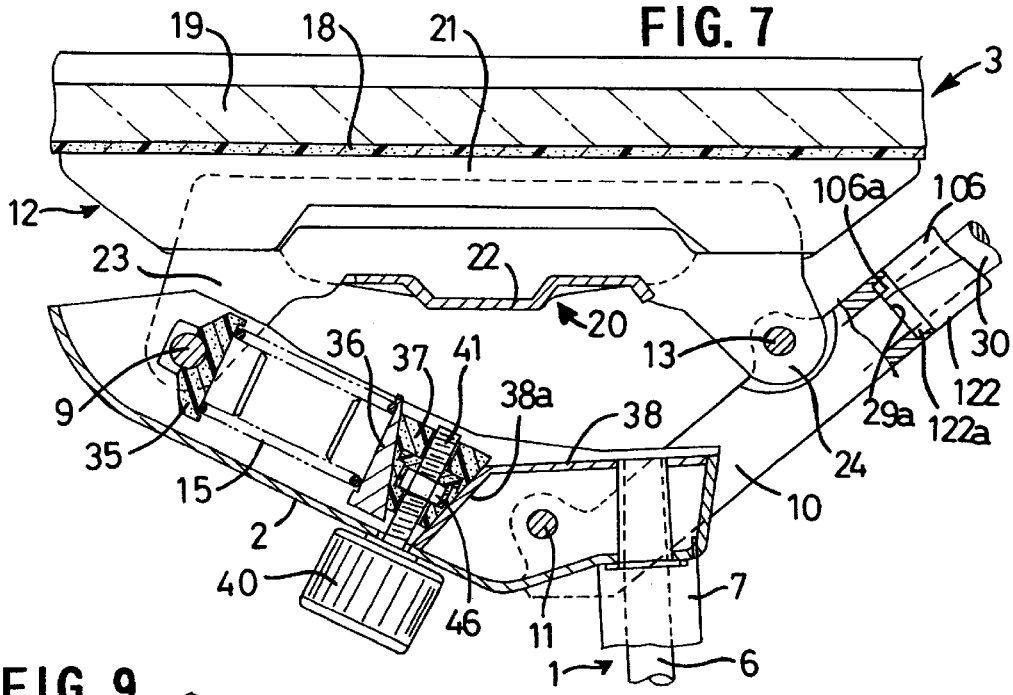
FIG. 7 is a sectional view of the seat taken along lines 7—7 in FIG. 4.
Figure 9:
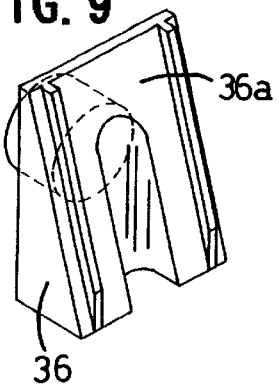
FIG. 9 is a perspective view showing the rear side of a rear supporting member used for receiving the rocking spring.

As shown in FIG. 7, the fitting elements 106 of the leg portion 32*b* of the outer back member 32 overlap the fitting portions 122 of the rear cover 105 to produce circular portions. The fitting elements 106 and the fitting portions 122 are provided with diametrically smaller parts 106*a* and 122*a*. These parts are fitted into diametrically greater holes 29 disposed at the rear ends of the arms 10. Thus, the outer back member 32 and the rear cover 105 are fixed firmly to the arms 10 at the locations of the fitting elements 106 and the fitting portions 122.

As shown in FIG. 37, the upper end of the rear cover 105 is fitted to a step portion 123 disposed at the lower edge of the primary portion 32*a* of the outer back member 32. Owing to the presence of the step portion 123, the rear cover 105 is held in position in a manner such that the rear cover is flush with the rear surface of the outer back member 32.

Figure 41:
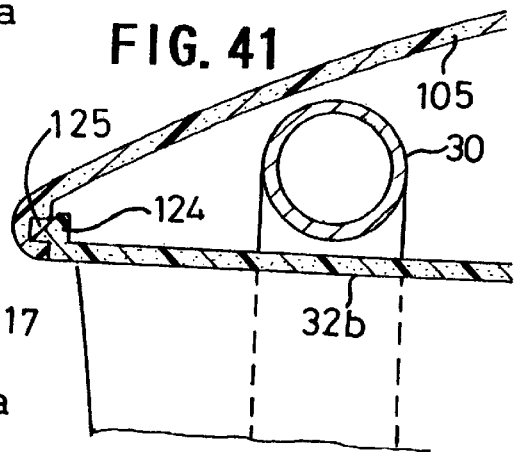
FIG. 41 is a sectional view taken along lines 41—41 in FIG. 33.

As shown in FIG. 41, the leg portion 32*b* of the outer back member 32 is formed, at its right and left edges, with vertically extending nails 124. The nails 124 are fitted into grooves 125, from behind, which are formed in the right and left edges of the rear cover 105. With such an arrangement, the rear cover 105 is prevented from unduly coming off even when the outer back member 32 is elastically deformed to some extent.

⑪ Others

In the seat and seat back, the clothes 19*a*, 104*a* covering the cushions 19, 104 are adhered, at their edges, to the inner members 18, 103. The cushions 19, 104 may be bonded to (or formed integrally with) the inner members 18, 103, or simply be superposed on them.

Figure 42:
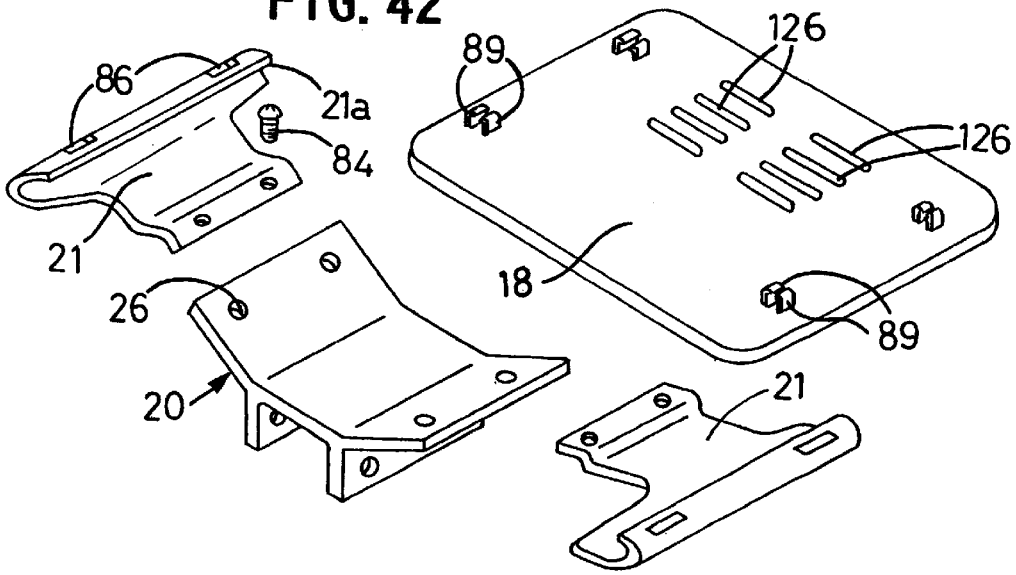
FIG. 42 is an exploded, perspective view showing a second embodiment.
Figure 43:
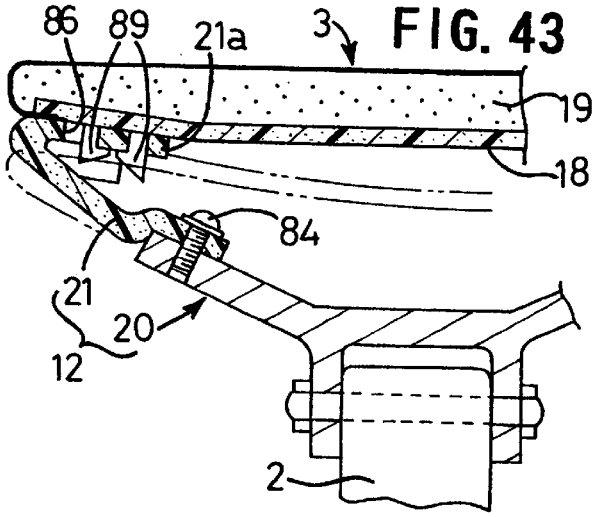
FIG. 43 is a front view showing, in section, part of the second embodiment.

(2) Second Embodiment (FIGS. 42–43)

FIGS. 42–43 show a seat of a chair according to a second embodiment. In this embodiment, an outer seat member 12 is made up of a base 20 and a pair of right and left auxiliary supporting elements 21. The auxiliary supporting elements 21 have an inwardly warped configuration as viewed in front elevation. The auxiliary supporting elements 21 are fixed to the base 20 by screws 84. An inner seat member 18 is attached to the auxiliary supporting elements 21 by engaging means which includes engagement nails 89 and engagement holes 86.

In this embodiment, the auxiliary supporting elements 21 are arranged to bend rather greatly, so that they also serve as a cushion. For facilitating deformation, the inner seat member 18 is formed with slits 126 in a region where the ischia of a person are placed.

Figure 44:
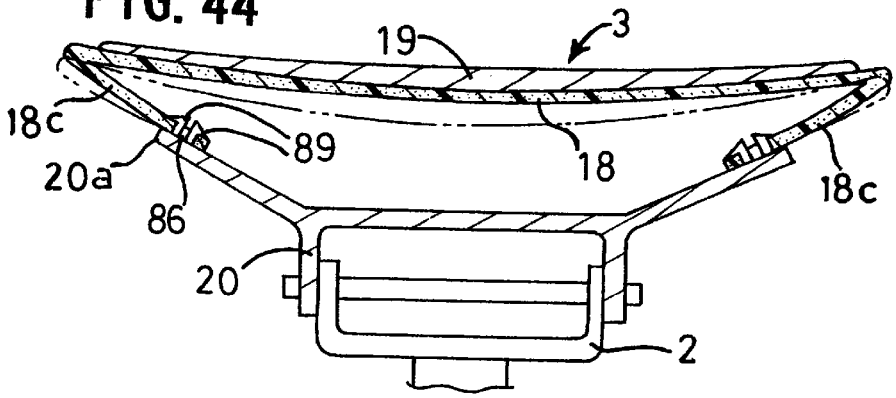
FIG. 44 is a front view showing a third embodiment in section.

(3) Third Embodiment (FIG. 44)

FIG. 44 shows a seat of a chair according to a third embodiment. In this embodiment, an inner back member 18 includes V-shaped, right and left ends which are provided with turned-back portions 18*c* projecting downwardly. These turned-back portions are attached to the outer seat member 12 via engaging means including engagement nails 89 and engagement holes 86. In this embodiment, V-shaped ends of the inner seat member 18 can be deformed elastically. Thus, the inner seat member also serves as a cushion.

Figure 45:
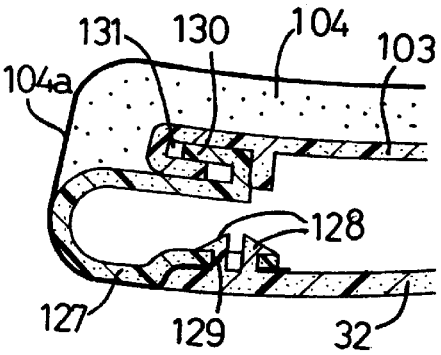
FIG. 45 is a plan view showing, in section, part of a fourth embodiment.

(4) Fourth Embodiment (FIG. 45)

FIG. 45 shows a seat back 4 of a chair according to a fourth embodiment. In this embodiment, use is made of an auxiliary supporting element 127 which has a U-shaped configuration as viewed in a horizontally extending cross section. The auxiliary supporting element is attached to an outer back member 32 via engaging means which includes engagement nails 128 and engagement holes 129. The auxiliary supporting element 127 is provided, on the front side thereof, with a key 130 to be fitted into a keyway 131 formed on the rear side of an inner back member 103. In this embodiment, not only the inner back member 103 but also the auxiliary supporting element 21 is elastically deformable to serve as a cushion.

Figure 46:
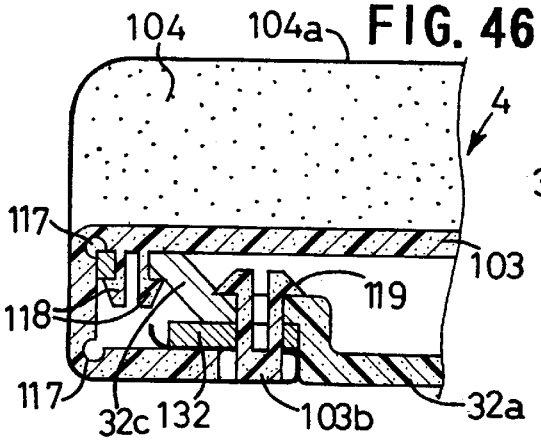
FIG. 46 is a plan view showing, in section, part of a fifth embodiment.

(5) Fifth Embodiment (FIG. 46)

FIG. 46 shows a seat back 4 of a chair according to a fifth embodiment. In this embodiment, the illustrated seat back is basically similar in arrangement to the seat back 4 of the first embodiment. Features differing from those of the first embodiment are that first engagement nails 119 and a first engagement hole 109 are laterally spaced by a great distance from second engagement nails 118 and a first engagement hole 110, and that a spacer 132 is provided at the location of the first engagement nails 119.

For facilitating the turning-back operation, the thickness of the inner back member 103 is reduced at locations of folding lines 117. In this embodiment, edges of a cloth 104*a* may simply be superposed on the inner back member 103.

Figure 47:
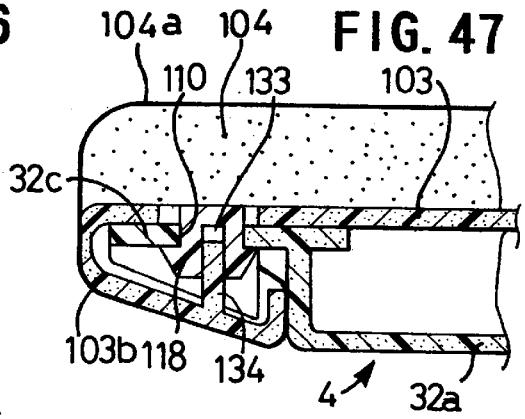
FIG. 47 is a plan view showing, in section, part of a sixth embodiment.

(6) Sixth Embodiment (FIG. 47)

FIG. 47 shows a seat back of a chair according to a sixth embodiment. In this embodiment, a positioning hole 133 is formed at the location of a first engagement nail 119. The first engagement nail is provided on an inner back member 103. A positioning protrusion 134 is formed on an embracing portion 103*b* to be fitted into the positioning hole 133.

Figure 48:
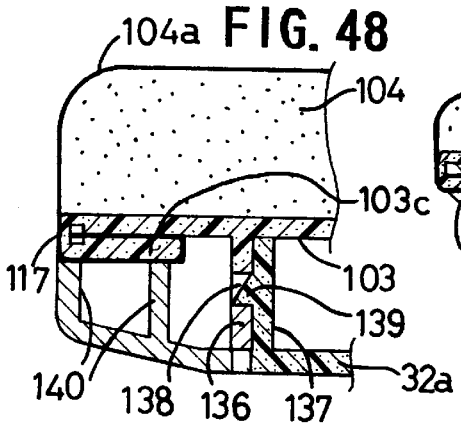
FIG. 48 is a plan view showing, in section, part of a seventh embodiment.

(7) Seventh Embodiment (FIG. 48)

FIG. 48 shows a seat back of a chair according to a seventh embodiment. In this embodiment, use is made of an inner back member 103 whose right and left ends are folded back to provide a two-layer configuration. The edge of a cloth 104*a* is pinched by the folded portion 103*c*. The inner back member 103 and an outer back member 32 are formed with a rib 136 and a rib 137 which overlap each other. The first-mentioned rib 136 is formed with an engagement hole 138, while the other rib 137 is formed with engagement nail 139.

Further, the outer back member 32 is provided with a presser rib 140 for holding the folded portion 103*c* of the inner back member 103.

Figure 49:
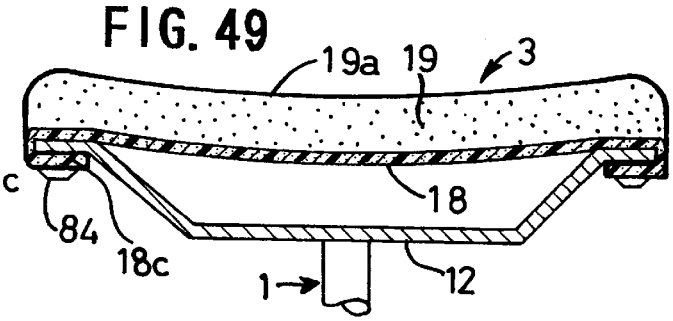
FIG. 49 is a plan view showing, in section, part of an eighth embodiment.

(8) Eighth Embodiment (FIG. 49)

FIG. 49 shows a seat 3 of a chair according to an eighth embodiment. In this embodiment, use is made of an inner seat member 18 which is provided, at its right and left ends, with embracing portions 18*c*. These embracing portions are folded back to the lower surface of the right and left ends of an outer seat member 12. In the illustrated example, the embracing portions 18*c* are fixed to the outer seat member 84 by screws 81. Alternatively, use may be made of engaging means such as engagement nails.

Figure 50:
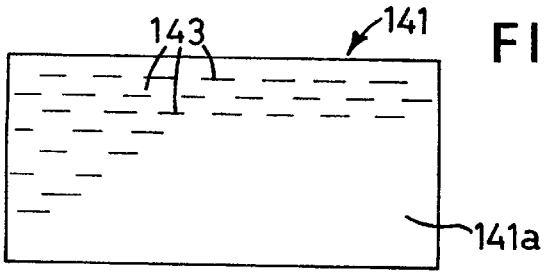
FIG. 50 is a plan view showing a bed embodying the present invention.
Figure 51:
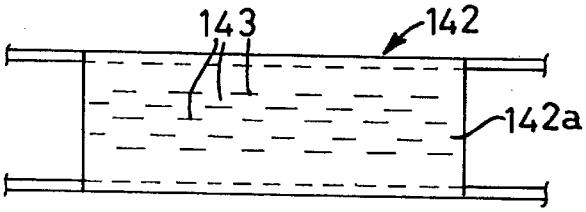
FIG. 51 is a plan view showing a stretcher embodying the present invention.

(9) Other Embodiments (FIGS. 50–51)

FIG. 50 is a plan view showing a bed 141 according to the present invention whereas FIG. 51 is a plan view showing a stretcher 142. Both the bed and the stretcher include inner members 141*a*, 142*a*, respectively, which are formed with a plurality of slits 143. In FIG. 50, only part of the slits are illustrated. In both figures, outer members used are not shown.

For a bed, a relatively large inner member is used. In such an instance, the inner member may be made up of a plurality of small parts.

(10) Other Possible Modifications

Each of the embodiments described above is only an example embodying the present invention, and the present invention may be varied in many other ways. For instance, in applying the present invention to a chair, an inner back member may be formed with a plurality of slits. Further, an inner seat member and an inner back member may be formed integrally with each other, or an outer seat member and an outer back member may be formed integrally with each other.

What is claimed is:

1. A body supporting apparatus comprising:

an inner member for supporting a user body; and an outer member disposed under the inner member for supporting the inner member and the user body;

wherein the inner member is made of a synthetic resin and formed into a plate, so that the inner member is elastically deformed under a weight of the user body;

wherein the inner membrane includes end portions which are located on the right and left sides of the user body supported by the inner membrane, the inner member being attached to the outer member with the end positions held in a supported state; and wherein the outer member comprises means for rendering at least part of the outer member to be also elastically deformed together with the inner member under the weight of the user body.

2. The body supporting apparatus according to claim 1, wherein the outer member comprises a base which is made of a metal plate and provided with spanning portions projecting outwardly toward a right end and a left end of the inner member, the outer member also comprising a pair of right and left auxiliary supporting elements which are made of a synthetic resin and fixed to the spanning portions of the base; and wherein the auxiliary supporting elements of the outer member are provided with bulging portions protruding outwardly of the base, the inner member being attached to ends of the bulging portions, the bulging portions of the auxiliary supporting elements being arranged to have a predetermined strength so that the bulging portions are deformed when the weight of the body is applied to the inner member.

3. The body supporting apparatus according to claim 2, the auxiliary supporting elements of the outer member are provided with connecting portions to be fitted on the spanning portions of the base from right and left outsides of the base.

4. The body supporting apparatus according to claim 1, wherein the inner member includes a comparatively thin portion on which the weight of the body intensively acts, the comparatively thin portion being smaller in thickness than other portions of the inner member; and wherein the inner member is formed with first slit groups consisting of a plurality of unit slits extending in a longitudinal direction of the body, the inner member being also formed with second slit groups consisting of a plurality of unit slits extending obliquely to the longitudinal direction of the body, the first and the second slit groups being spaced from each other in a lateral direction, at least most of the unit slits of the first slit groups being protected by thick-walled ribs.

5. The body supporting apparatus according to claim 1, wherein side portions of the outer member and side portions of the inner member are pressed onto each other in an overlapping manner, so that the side portions of the outer and the inner members are fixed to each other by engaging means which include elastic engagement nails and engagement holes into which the engagement nails are fitted against elastic force.

6. The body supporting apparatus according to claim 1, wherein a cushion material such as a sponge is laid over a surface of the inner member.

7. The body supporting apparatus according to claim 1, wherein the outer member includes connecting portions for connection to the inner member, the connecting portions of the outer member being elastically deformed together with the inner member under the weight of the user body.

8. A body supporting apparatus comprising:

an inner member for supporting a user body; and an outer member for supporting the inner member;

wherein the inner member is made of a synthetic resin and formed into a plate, so that the inner member is elastically deformed to sag under a weight of the user body;

wherein the inner member is attached to the outer member via end portions of the inner member so that the inner member is allowed to be elastically deformed to sag under the weight of the user body; and wherein the inner member is formed with a plurality of slit groups each of which includes a plurality of slits, the slits being arranged in a weight applying area so that portions of the inner member to which the user body applies a greater pressing force are allowed to be deformed to sag to a greater extent, the slits in each of the slit groups extending in a same direction, but spaced from each other in a direction that is transverse to said slit extending direction, thereby the slits in each of the two adjacent slit groups extending in different directions.

9. The body supporting apparatus according to claim 8, wherein the inner member includes a comparatively thin portion on which the user weight of the body intensively acts, the comparatively thin portion being smaller in thickness than other portions of the inner member; and wherein the inner member is formed with first slit groups consisting of a plurality of unit slits extending in a longitudinal direction of the user body, the inner member being also formed with second slit groups consisting of a plurality of unit slits extending obliquely to the longitudinal direction of the body, the user first and the second slit groups being spaced from each other in a lateral direction, at least most of the unit slits of the first slit groups being protected by thick-walled ribs.

10. The body supporting apparatus according to claim 8, wherein each of the slits terminates in an enlarged round hole at each end.

11. The body supporting apparatus according to claim 8, wherein a cushion material is laid over a surface of the inner member.

12. The body supporting apparatus according to claim 8, wherein the slits in at least one slit group of the plurality of slit groups are arranged in staggered relationship.

13. The body supporting apparatus according to claim 8, wherein the slits in at least one slit group of the plurality of slit groups vary in length.

14. The body supporting apparatus according to claim 8, wherein the slits in at least one slit group of the plurality of slit groups are different in length from those in another selected slit group.

15. A body supporting apparatus comprising:

an inner member for supporting a user body; and an outer member for supporting the inner member;

wherein the inner member is made of a synthetic resin and formed into a plate, so that the inner member is elastically deformed to sag under a weight of the user body;

wherein the inner member is attached to the outer member via end portions of the inner member so that the inner member is allowed to be elastically deformed to sag under the weight of the user body; and wherein the inner member is formed with a plurality of slits so that portions of the inner member to which the user body applies a greater pressing force are allowed to be deformed to sag to a greater extent, each of the slits terminating in an enlarged round hole at each end.

16. A body supporting apparatus comprising:

a lower support;

an outer member connected to the lower support; and an inner member disposed above and connected to the outer support for supporting a user body in combination with the outer member;

wherein the inner member is made of a synthetic resin and formed into a plate, so that the inner member is elastically deformed under a weight of the user body;

wherein the inner member includes end portions which are located on the right and left sides of the user body supported by the inner member, the inner member being attached to the outer member with the end portions held in a supported state; and wherein the outer member comprises means for rendering at least part of the outer member to be also elastically deformed together with the inner member under the weight of the user body.

17. A body supporting apparatus comprising:

an inner member for supporting a user body; and an outer member disposed under the inner member for supporting the inner member and the user body;

wherein the inner member is made of a synthetic resin and formed into a plate, so that the inner member is elastically deformed under a weight of the user body;

wherein the inner member includes turn-back portions which are located on the right and left sides of the user body supported by the inner member, the turned-back portions of the inner member being attached to the outer member; and wherein the outer member comprises means for rendering at least part of the outer member to be also elastically deformed together with the inner member under the weight of the user body.

* * * * *